US006647935B2

(12) United States Patent
Aoyama et al.

(10) Patent No.: US 6,647,935 B2
(45) Date of Patent: Nov. 18, 2003

(54) RECIPROCATING INTERNAL COMBUSTION ENGINE

(75) Inventors: Shunichi Aoyama, Kanagawa (JP); Katsuya Moteki, Tokyo (JP); Kenshi Ushijima, Kanagawa (JP); Ryosuke Hiyoshi, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/170,683

(22) Filed: Jun. 14, 2002

(65) Prior Publication Data

US 2003/0019448 A1 Jan. 30, 2003

(30) Foreign Application Priority Data

Jul. 25, 2001 (JP) ..... 2001-224519

(51) Int. Cl.[7] ..... F01L 1/34

(52) U.S. Cl. ..... 123/90.16; 123/90.27; 123/90.31; 123/53.1; 123/198 F

(58) Field of Search ..... 123/90.15, 90.16, 123/90.18, 90.27, 90.31, 53.1, 53.5, 198 F, 195 AC, 90.48, 90.55; 29/888.2

(56) References Cited

U.S. PATENT DOCUMENTS 5,353,755 A * 10/1994 Matsuo et al. ..... 123/90.13
6,213,826 B1 * 4/2001 Koishikawa et al. ..... 440/88 R
6,497,206 B2 * 12/2002 Nohara et al. ..... 123/90.16
6,543,225 B2 * 4/2003 Scuderi ..... 60/597

FOREIGN PATENT DOCUMENTS

JP 2001-263099 9/2001

OTHER PUBLICATIONS

Bollig et al., "Kurbeltrieb Für variable Verdichtung" MTZ Motortechnische Zeitschrift 58, No. 11, pp. 706–711 of the Issue for 1997 of the paper.

* cited by examiner

*Primary Examiner*—Thomas Denion
*Assistant Examiner*—Ching Chang
(74) *Attorney, Agent, or Firm*—Foley & Lardner

(57) ABSTRACT

In a rockable-cam equipped reciprocating internal combustion engine, a rockable cam is rotatably fitted on the outer periphery of an intake-valve drive shaft that is rotatable in synchronism with rotation of a crankshaft. The rockable cam oscillates within predetermined limits during rotation of the intake-valve drive shaft so as to directly push an intake-valve lifter. As viewed from an axial direction of the crankshaft, an axis of the intake-valve drive shaft is offset from a centerline of the intake-valve stem in a first direction that is normal to both the cylinder centerline and the crankshaft axis and directed from the cylinder centerline to the intake valve side. The crankshaft axis is also offset from the cylinder centerline in the first direction.

10 Claims, 14 Drawing Sheets

RECIPROCATING INTERNAL COMBUSTION ENGINE

TECHNICAL FIELD

The present invention relates to a reciprocating internal combustion engine, and specifically to a reciprocating engine employing a rockable cam capable of oscillating within limits so as to directly push a valve lifter of an intake valve.

BACKGROUND ART

A well-known direct-driven valve operating mechanism that a valve lifter of an engine valve is driven or pushed directly by means of a cam (hereinafter is referred to as "fixed cam") formed as an integral section of a camshaft, is superior to a rocker-arm type or a lever type, in compactness, design simplicity, and enhanced rotational-speed limits. In the direct-driven valve operating mechanism, in order to provide a wide range of contact between the cam surface of the fixed cam and the valve lifter without undesirably eccentric contact in a very limited contact zone, generally the axis (the center of rotation) of the camshaft lies on the prolongation of the centerline of the valve stem of the engine valve (each of intake and exhaust valves). Thus, the center distance between the center of the intake-valve camshaft and the center of the exhaust-valve camshaft is in proportion to the angle between the center of the intake-valve stem and the center of the exhaust-valve stem. As is generally known, in typical reciprocating internal combustion engines, a crankpin is connected to a piston pin by means of a single link known as a "connecting rod". In such single-link type reciprocating engines, for the purpose of reduced side thrust acting on the piston, the crankshaft axis (crankshaft centerline) lies on the cylinder centerline, as viewed from the axial direction of the crankshaft. The assignee of the present invention has proposed and developed a variable valve operating mechanism (see FIG. 4) continuously varying a valve lift characteristic (at least a valve lift and a working angle) and widely applied to the previously-discussed direct-driven valve gear layout. In the variable valve operating mechanism as shown in FIG. 4, in order to drive an intake-valve operating mechanism, a drive shaft is laid out parallel to the crankshaft axis, in a similar manner as the typical camshaft having fixed cams formed as integral sections of the camshaft. A rockable cam is rotatably fitted onto the outer periphery of the drive shaft such that the oscillating motion of the rockable cam is permitted within predetermined limits and the valve lifter is pushed directly by the cam surface of the rockable cam. Changing an initial phase of the rockable cam continuously changes the valve lift characteristic. For instance, when the rockable cam is used in the intake-valve operating system instead of using the fixed cam, it is desirable that the center of oscillating motion of the rockable cam (that is, the axis of the drive shaft) is offset from the centerline of the valve stem of the intake valve, from the viewpoint of a widened contact area between the cam surface of the rockable cam and the valve lifter and reduced side thrust acting on the valve lifter associated with the intake valve. However, if only the drive shaft of the intake valve is simply offset from the center of the intake-valve stem, the geometry and dimensions between the intake-valve drive shaft and the crankshaft become different from the geometry and dimensions between the exhaust-valve camshaft (or the exhaust-valve drive shaft) and the crankshaft. In such a case, the engine design including a power transmission system layout from the crankshaft to the drive shaft (or the camshaft) has to be largely changed. The assignee of the present invention has also proposed and developed a multi-link type reciprocating engine employing a variable piston stroke characteristic mechanism (see FIG. 2) continuously varying a compression ratio. In case of such multi-link type reciprocating engines, taking account of the magnitude of load applied to each link as well as piston side thrust, it is undesirable to arrange the crankshaft centerline on the cylinder centerline viewed from the axial direction of the crankshaft. However, the simple offset of only the drive shaft of the intake valve from the center of the intake-valve stem, leads to the problem of the differences between (i) the geometry and dimensions between the intake-valve drive shaft and the crankshaft and (ii) the geometry and dimensions between the exhaust-valve camshaft (or the exhaust-valve drive shaft) and the crankshaft.

SUMMARY OF THE INVENTION

Accordingly, it is an object of the invention to provide a reciprocating internal combustion engine employing a rockable cam capable of oscillating within predetermined limits so as to directly push a valve lifter of an intake valve, which avoids the aforementioned disadvantages.

It is another object of the invention to provide an improved layout among a cylinder centerline, a crankshaft centerline, a center of oscillating motion of a rockable cam (i.e., a center of an intake-valve drive shaft), and a center of an intake-valve stem, in a reciprocating internal combustion engine employing the rockable cam capable of oscillating within predetermined limits so as to directly push a valve lifter of the intake valve.

In order to accomplish the aforementioned and other objects of the present invention, a reciprocating internal combustion engine comprises a cylinder block having a cylinder, a piston movable through a stroke in the cylinder, an intake valve, an intake-valve lifter on a stem of the intake valve, an intake-valve drive shaft that rotates about its axis in synchronism with rotation of a crankshaft, a rockable cam that is rotatably fitted on an outer periphery of the intake-valve drive shaft, and that oscillates within predetermined limits during rotation of the intake-valve drive shaft so as to directly push the intake-valve lifter, and as viewed from an axial direction of the crankshaft, an axis of the intake-valve drive shaft being offset from a centerline of the intake-valve stem in a first direction that is normal to both a centerline of the cylinder and an axis of the crankshaft and directed from the cylinder centerline to an intake valve side, and the crankshaft axis being offset from the cylinder centerline in the first direction.

The other objects and features of this invention will become understood from the following description with reference to the accompanying drawings.

DESCRIPTION OF THE PREFERRED EMBODIMENTS

Figure 2:
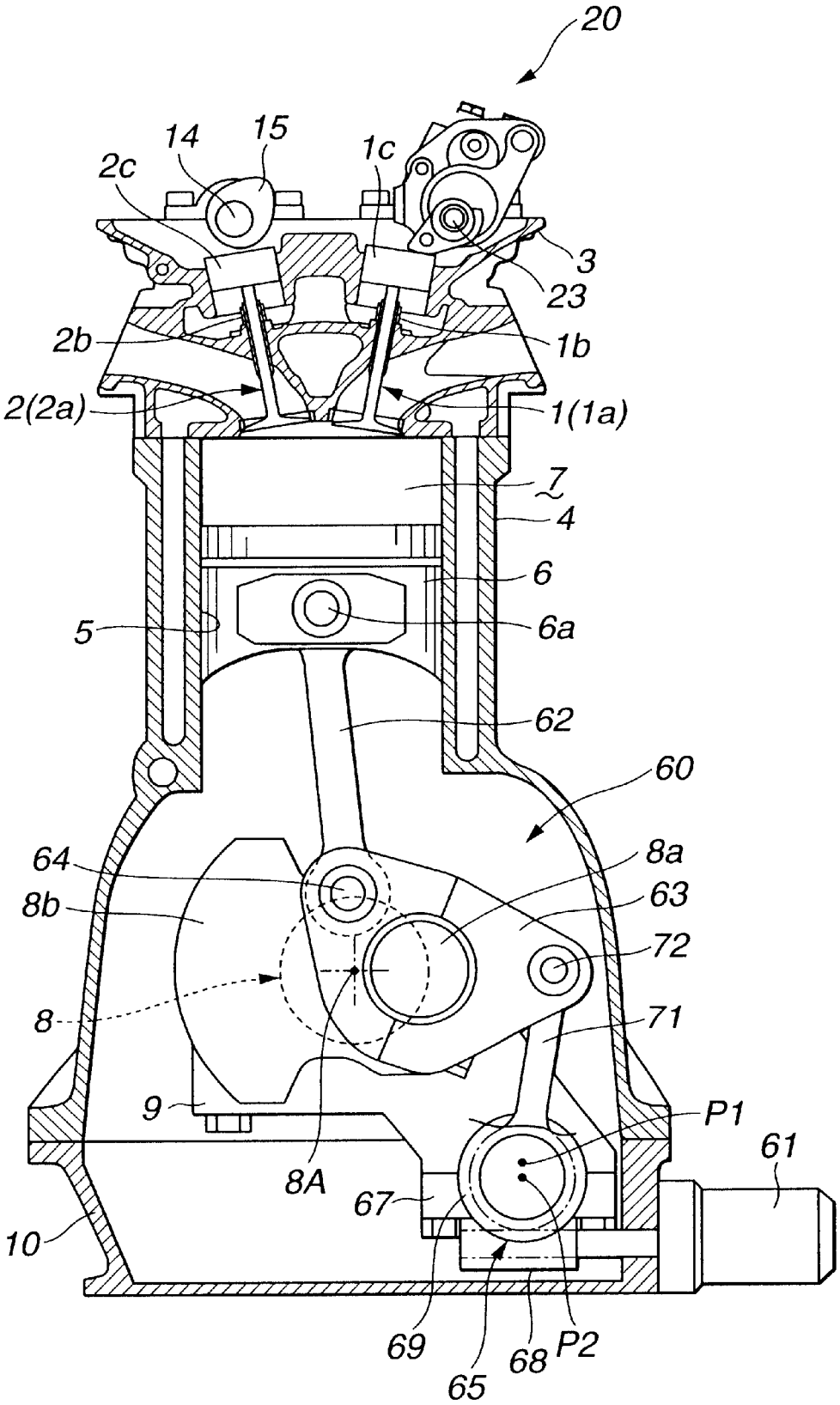
FIG. 2 is a cross-sectional view illustrating the essential linkage and valve operating mechanism layout of the embodiment, which is applied to a multi-link type reciprocating engine, as viewed from the axial direction of the crankshaft.

Referring now to the drawings, particularly to FIG. 2, the rockable cam equipped reciprocating engine of the embodiment is exemplified in a multi-link type four-valve spark-ignited reciprocating internal combustion engine. As shown in FIG. 2, an intake-valve stem 1*a* of each of a pair of intake valves (1, 1) for each engine cylinder is slidably supported by means of a valve guide 1*b*. An exhaust-valve stem 2*a* of each of a pair of exhaust valves (2, 2) for each engine cylinder is slidably supported by means of a valve guide 2*b*. An intake-valve lifter 1*c*, having a cylindrical bore closed at its upper end, is provided at the intake-valve stem end. An exhaust-valve lifter 2*c*, having a cylindrical bore closed at its upper end, is provided at the exhaust-valve stem end. In FIG. 2, a portion denoted by reference sign 5 is an engine cylinder that is bored in a cylinder block 4, whereas a portion denoted by reference sign 6 is a reciprocating piston movable through a stroke in the cylinder. The piston crown of piston 6 cooperates with the inner peripheral wall surface of cylinder head 3 to define a combustion chamber 7. A crankshaft 8 is rotatably mounted on cylinder block 4 by means of main bearing caps 9. Crankshaft 8 is integrally formed thereon with a crankpin 8*a* for each engine cylinder. The crankpins on crankshaft 8 are offset from or eccentric with respect to the centerline of crankshaft 8 (crankshaft axis 8A). Crankshaft 8 is also formed with counter weights 8*b* that are arranged in place to counterbalance various forces, which may occur during rotation of the crankshaft. An oil pan 10, serving as a lubricating oil reservoir, is detachably installed on the bottom end of cylinder block 4.

Figure 3:
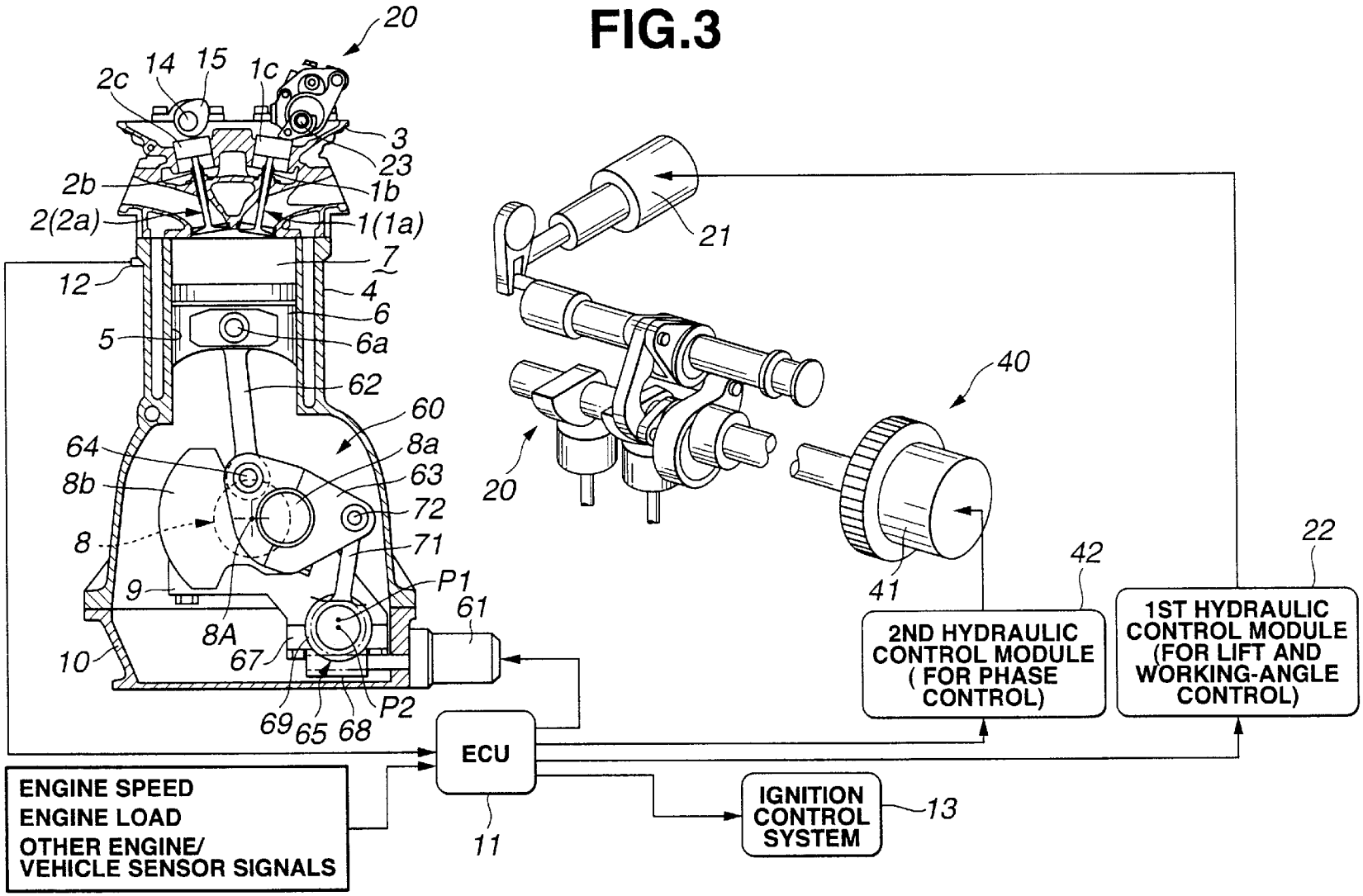
FIG. 3 is a system block diagram illustrating the basic construction of the reciprocating engine of FIG. 2, employing a variable lift and working-angle control mechanism, a variable phase control mechanism, and a variable piston stroke characteristic mechanism.

Referring now to FIG. 3, there is shown the system block diagram of the reciprocating engine employing three different variable mechanisms, namely a variable valve lift characteristic mechanism (a variable lift and working-angle control mechanism 20), a variable phase control mechanism 40, and a variable compression ratio mechanism (a variable piston stroke characteristic mechanism 60). Variable lift and working-angle control mechanism 20 functions to continuously change (increase or decrease) both a valve lift and a working angle of intake valve 1, depending on engine/vehicle operating conditions. On the other hand, variable phase control mechanism 40 functions to continuously change (advance or retard) the angular phase at the maximum valve lift point (at the central angle $\phi$ of the working angle of intake valve 1). Variable piston stroke characteristic mechanism 60 functions to continuously change the piston stroke characteristic (containing both a top dead center position and a bottom dead center position), depending on engine operating conditions. As hereunder described in detail, the three different variable mechanisms 20, 40 and 60 are electronically controlled in response to respective control signals from an electronic engine control unit (ECU) 11.

Electronic engine control unit ECU 11 generally comprises a microcomputer. ECU 11 includes an input/output interface (I/O), memories (RAM, ROM), and a microprocessor or a central processing unit (CPU). The input/output interface (I/O) of ECU 11 receives input information from various engine/vehicle sensors, namely a crank angle sensor or a crank position sensor (an engine speed sensor), a throttle-opening sensor (an engine load sensor), a knock sensor (a detonation sensor) 12, an exhaust-temperature sensor, an engine vacuum sensor, an engine temperature sensor, an engine oil temperature sensor, an accelerator-opening sensor and the like. Knock sensor 12 is mounted on the engine to detect cylinder ignition knock (the intensity of detonation or combustion chamber knock), with its location being often screwed into the coolant jacket or into the engine cylinder block. Instead of using the throttle opening as engine-load indicative data, negative pressure in an intake pipe or intake manifold vacuum or a quantity of intake air or a fuel-injection amount may be used as engine load parameters. Within ECU 11, the central processing unit (CPU) allows the access by the I/O interface of input informational data signals from the previously-discussed engine/vehicle sensors. The CPU of ECU 11 is responsible for carrying an electronic ignition timing control program for an ignition timing advance control system 13 and an electronic fuel injection control program related to fuel injection amount control and fuel injection timing control, and also responsible for carrying variable piston stroke characteristic control (variable compression-ratio $\epsilon$ control), variable intake-valve lift and working-angle control, and variable intake-valve central angle $\phi$ control (variable intake-valve phase control) stored in memories, and is capable of performing necessary arithmetic and logic operations. Computational results (arithmetic calculation results), that is, calculated output signals (drive currents) are relayed via the output interface circuitry of the ECU to output stages, namely electronic ignition timing advance control system (an ignition timing advancer) 13, electromagnetic solenoids constructing component parts of first and second hydraulic control modules 22 and 42, and an electronically controlled piston-stroke characteristic control actuator 61.

Figure 4:
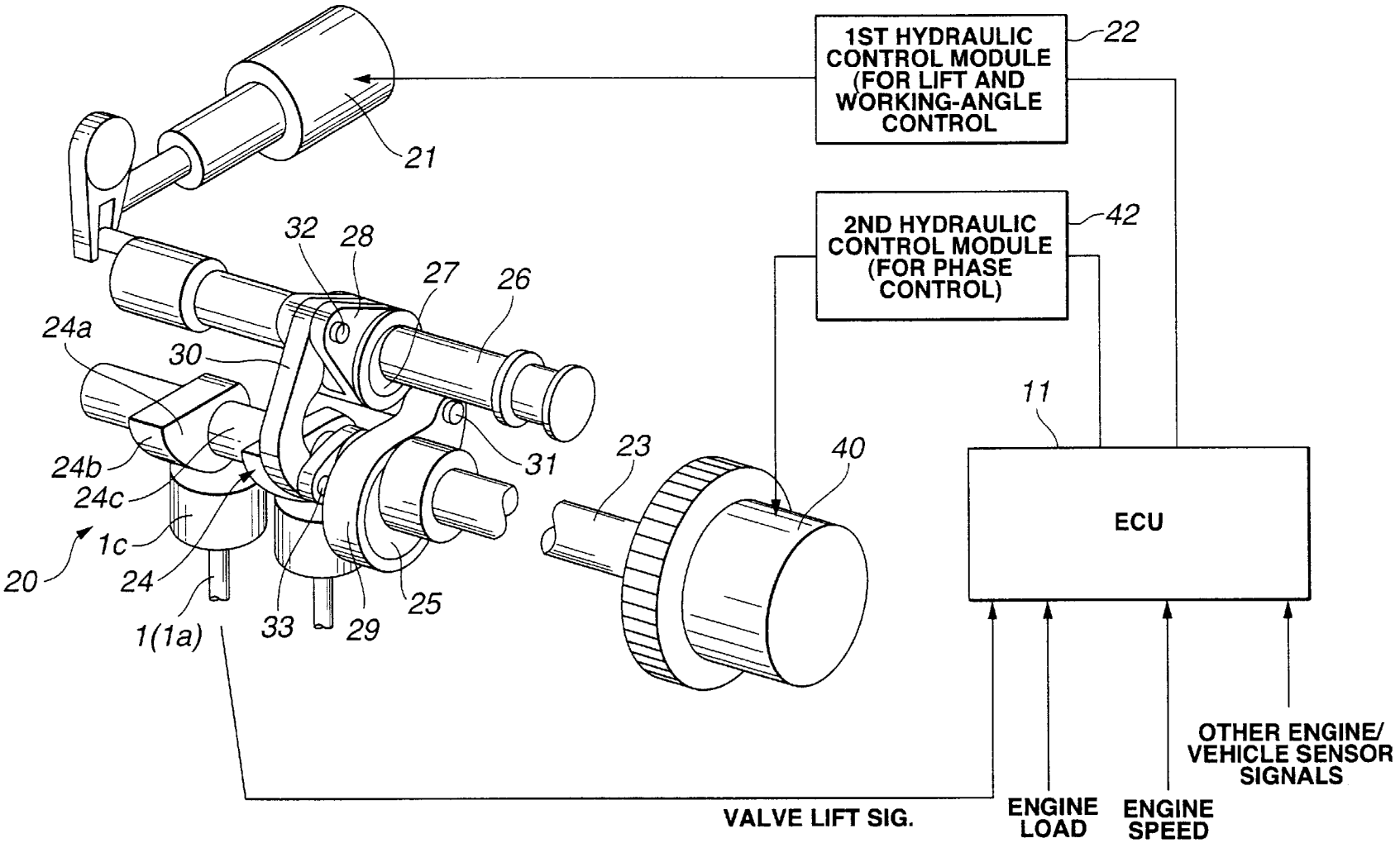
FIG. 4 is a perspective view illustrating the variable valve operating mechanism (containing both the variable lift and working-angle control mechanism and the variable phase control mechanism).

Referring now to FIG. 4, there is shown the fundamental structure of the essential part of variable intake-valve lift and working-angle control mechanism 20. The fundamental structure of variable lift and working-angle control mechanism 20 is hereunder described briefly.

A cylindrical-hollow intake-valve drive shaft 23 is located above the intake valves in such a manner as to extend in a cylinder-row direction. Drive shaft 23 is rotatably supported by a cam bracket (not shown) located on the upper portion of cylinder head 3. A rockable cam 24 is rotatably fitted on the outer periphery of drive shaft 23 so as to directly push intake-valve lifter 1*c*. Intake-valve drive shaft 23 and rockable cam 24 are mechanically linked to each other by means of variable lift and working-angle control mechanism 20. Variable lift and working-angle control mechanism 20 is mainly comprised of a first eccentric cam 25 attached to or fixedly connected to intake-valve drive shaft 23 by way of press-fitting, a control shaft 26 which is rotatably supported by the cam bracket above drive shaft 23 and arranged parallel to drive shaft 23, a second eccentric cam 27 attached to or fixedly connected or integrally formed with control shaft 26, a rocker arm 28 oscillatingly or rockably supported on second eccentric cam 27, a substantially ring-shaped first link 29 (described later), and a substantially boomerang-shaped second link 30 (described later). In the exemplified four-valve reciprocating engine, two cam bodies (24*b*, 24*b*), each of which has a cam nose portion 24*a* and is in contact with the upper closed end face of the associated intake-valve lifter, are integrally connected to each other via a substantially cylindrical journal portion 24*c*. First eccentric cam 25 and rocker arm 28 are mechanically linked to each other through first link 29 that rotates relative to first eccentric cam 25. On the other hand, rocker arm 28 and rockable cam 24 are linked to each other through second link 30, so that the oscillating motion of rocker arm 28 is produced via first link 29. Drive shaft 23 is driven by engine crankshaft 8 via a timing chain or a timing belt such that the drive shaft rotates about its axis in synchronism with rotation of the crankshaft. First eccentric cam 25 is cylindrical in shape. The central axis of the cylindrical outer peripheral surface of first eccentric cam 25 is eccentric to the axis of drive shaft 23 by a predetermined eccentricity. A substantially annular portion of first link 29 is rotatably fitted onto the cylindrical outer peripheral surface of first eccentric cam 25. Rocker arm 28 is oscillatingly supported at its substantially annular central portion by second eccentric cam 27 of control shaft 26. A protruded portion of first link 25 is linked to one end of rocker arm 28 by means of a first connecting pin 31. The upper end of second link 30 is linked to the other end of rocker arm 28 by means of a second connecting pin 32. The axis of second eccentric cam 27 is eccentric to the axis of control shaft 26, and thus the center of oscillating motion of rocker arm 28 can be varied by changing the angular position of control shaft 26. Rockable cam 24 is rotatably fitted onto the outer periphery of drive shaft 23. One end portion of rockable cam 24 is linked to second link 30 by means of a third connecting pin 33. With the linkage structure discussed above, rotary motion of drive shaft 23 is converted into oscillating motion of rockable cam 24. Rockable cam 24 is formed on its lower surface with a base-circle surface portion being concentric to drive shaft 23 and a moderately-curved cam surface portion being continuous with the base-circle surface portion and extending toward the other end portion of rockable cam 24. The base-circle surface portion and the cam surface portion of rockable cam 24 are designed to be brought into abutted-contact (sliding-contact) with a designated point or a designated position of the upper surface of the associated intake-valve lifter, depending on an angular position of rockable cam 24 oscillating. That is, the base-circle surface portion functions as a base-circle section within which a valve lift is zero. A predetermined angular range of the cam surface portion being continuous with the base-circle surface portion functions as a ramp section. A predetermined angular range of cam nose portion 24*a* of the cam surface portion that is continuous with the ramp section, functions as a lift section. As clearly shown in FIG. 4, control shaft 26 of variable lift and working-angle control mechanism 20 is driven within a predetermined angular range by means of a lift and working-angle control hydraulic actuator 21. A controlled pressure applied to hydraulic actuator 21 is regulated or modulated by way of a first hydraulic control module (a lift and working-angle control hydraulic modulator) 22 which is responsive to a control signal from ECU 11. Hydraulic actuator 21 is designed so that the angular position of the output shaft of hydraulic actuator 22 is forced toward and held at an initial angular position by a return spring means with first hydraulic control module 22 de-energized. In a state that hydraulic actuator 21 is kept at the initial angular position, the intake valve is operated with the valve lift reduced and the working angle reduced. Variable lift and working-angle control mechanism 20 operates as follows.

During rotation of drive shaft 23, first link 29 moves up and down by virtue of cam action of first eccentric cam 25. The up-and-down motion of first link 29 causes oscillating motion of rocker arm 28. The oscillating motion of rocker arm 28 is transmitted via second link 30 to rockable cam 24, and thus rockable cam 24 oscillates. By virtue of cam action of rockable cam 24 oscillating, intake-valve lifter 1*c* is pushed and therefore intake valve 1 lifts. If the angular position of control shaft 26 is varied by hydraulic actuator 21, an initial position of rocker arm 28 varies and as a result an initial position (or a starting point) of the oscillating motion of rockable cam 24 varies. Assuming that the angular position of second eccentric cam 27 is shifted from a first angular position that the axis of second eccentric cam 27 is located just under the axis of control shaft 26 to a second angular position that the axis of second eccentric cam 27 is located just above the axis of control shaft 26, as a whole rocker arm 28 shifts upwards. As a result, the initial position (the starting point) of rockable cam 24 is displaced or shifted so that the rockable cam itself is inclined in a direction that the cam surface portion of rockable cam 24 moves apart from intake-valve lifter 1*c*. With rocker arm 28 shifted upwards, when rockable cam 24 oscillates during rotation of drive shaft 23, the base-circle surface portion is held in contact with intake-valve lifter 1*c* for a comparatively long time period. In other words, a time period within which the cam surface portion is held in contact with intake-valve lifter 1*c* becomes short. As a consequence, a valve lift becomes small. Additionally, a lifted period (i.e., a working angle) from intake-valve open timing (IVO) to intake-valve closure timing (IVC) becomes reduced.

Figure 5:
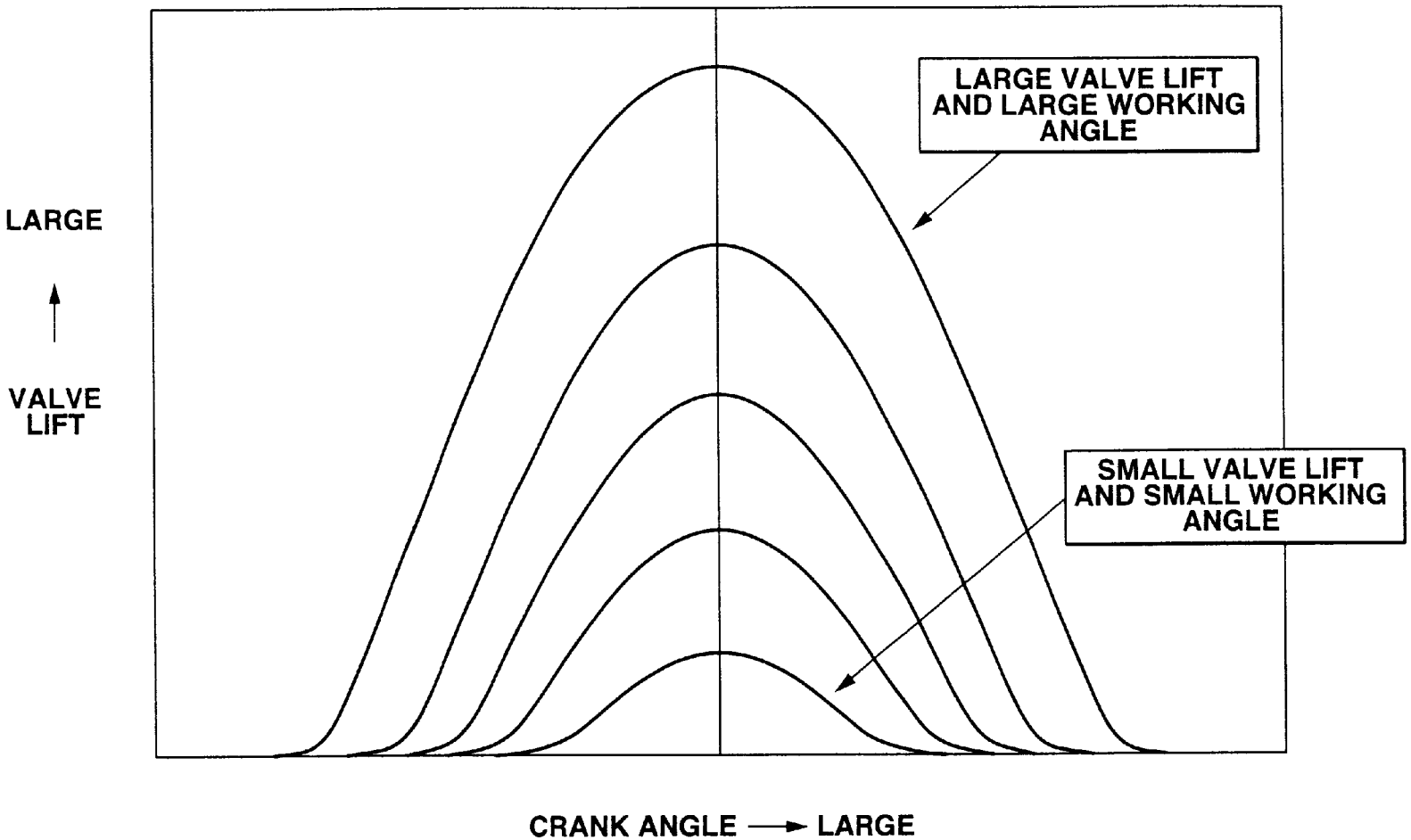
FIG. 5 shows lift and working-angle characteristic curves given by the variable lift and working-angle control mechanism of FIG. 4.

Conversely when the angular position of second eccentric cam 27 is shifted from the second angular position that the axis of second eccentric cam 27 is located just above the axis of control shaft 26 to the first angular position that the axis of second eccentric cam 27 is located just under the axis of control shaft 26, as a whole rocker arm 28 shifts downwards. As a result, the initial position (the starting point) of rockable cam 24 is displaced or shifted so that the rockable cam itself is inclined in a direction that the cam surface portion of rockable cam 24 moves towards intake-valve lifter 1*c*. With rocker arm 28 shifted downwards, when rockable cam 24 oscillates during rotation of drive shaft 23, a portion that is brought into contact with intake-valve lifter 1*c* is somewhat shifted from the base-circle surface portion to the cam surface portion. As a consequence, a valve lift becomes large. Additionally, a lifted period (i.e., a working angle) from intake-valve open timing (IVO) to intake-valve closure timing (IVC) becomes extended. The angular position of second eccentric cam 27 can be continuously varied within predetermined limits by means of hydraulic actuator 21, and thus valve lift characteristics (valve lift and working angle) also vary continuously as shown in FIG. 5. As can be seen from the variable valve lift characteristics of FIG. 5, variable lift and working-angle control mechanism 20 can scale up and down both the valve lift and the working angle continuously simultaneously. As clearly seen in FIG. 5, in the variable lift and working-angle control mechanism 20 incorporated in the reciprocating engine of the embodiment, intake-valve open timing IVO and intake-valve closure timing IVC vary symmetrically with each other, in accordance with a change in valve lift and a change in working angle.

The previously-noted variable intake-valve lift and working-angle control mechanism 20 has the following merits.

Firstly, rockable cam 24 capable of directly pushing intake-valve lifter 1*c* is coaxially arranged on intake-valve drive shaft 23 that is rotated in synchronism with rotation of crankshaft 8. The layout between intake-valve drive shaft 23 and rockable cam 24 is similar to a conventional direct-driven valve operating mechanism that a valve lifter is driven directly by means of a fixed cam formed as an integral section of the camshaft. Thus, the layout between intake-valve drive shaft 23 and rockable cam 24 is advantageous with respect to compactness and enhanced rotational-speed limits. Additionally, the coaxial arrangement of drive shaft 23 and rockable cam 24 eliminates the problem of axial misalignment between the axis of drive shaft 23 and the axis of rockable cam 24. This enhances the control accuracy. Secondly, as can be seen from the bearing portion between the cam surface of first eccentric cam 25 and the inner peripheral wall surface of first link 29, and the bearing portion between the cam surface of second eccentric cam 27 and the inner peripheral wall surface of the substantially annular central portion of rocker arm 28, first eccentric cam 25 is wall contact with first link 29, and additionally second eccentric cam 27 is wall contact with rocker arm 28. Such a wall-contact structure is applied to almost all of the joining portions of component parts constructing the multi-linkage. The wall contact is superior in good lubrication. Furthermore, variable lift and working-angle control mechanism 20 scarcely uses a biasing means such as a return spring, thus enhancing durability and reliability.

As appreciated from the cross section of FIG. 2, in the shown embodiment, variable lift and working-angle control mechanism 20 and variable phase control mechanism 40 (described later) are not applied to the exhaust valve side. In contrast to the intake valve side, as can be seen from the upper left sections of FIGS. 1 and 2, on the exhaust valve side, the conventional direct-driven valve operating mechanism that exhaust-valve lifter 2*c* is driven directly by means of a fixed cam 15 formed as an integral section of an exhaust-valve camshaft (exhaust-valve drive shaft 14) and simple in construction, is used.

Figure 6:
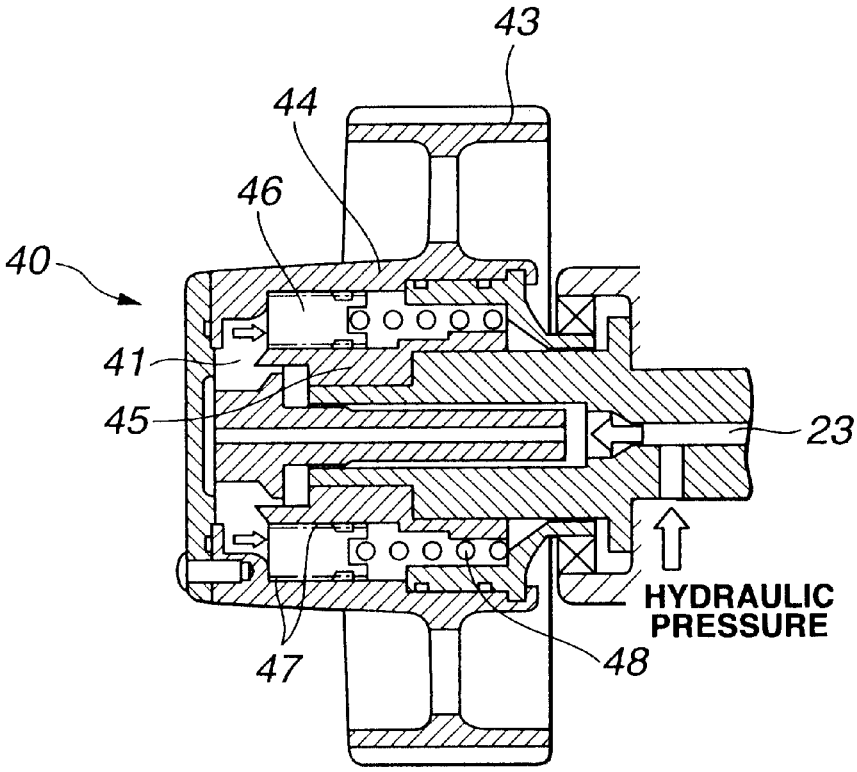
FIG. 6 is a longitudinal cross-sectional view illustrating a helical spline type variable valve timing control mechanism (a helical spline type variable phase control mechanism).
Figure 7:
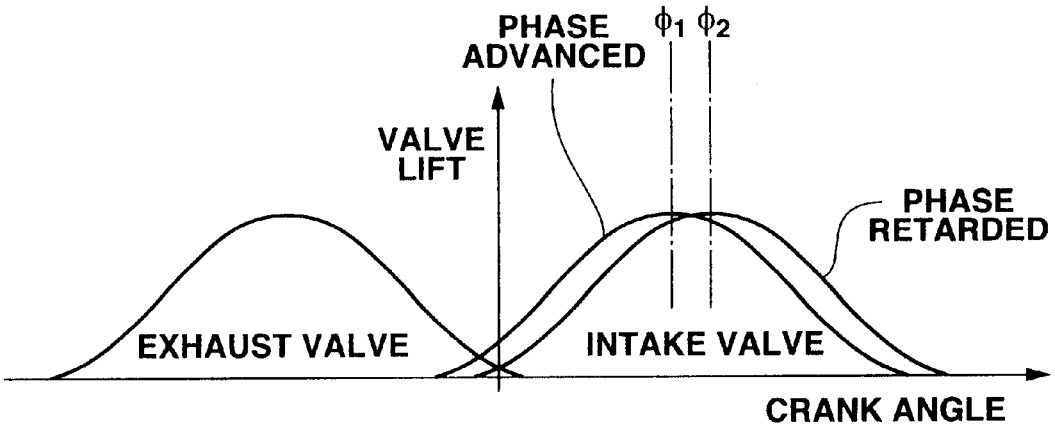
FIG. 7 shows phase-change characteristic curves for a phase of working angle that means an angular phase at the maximum valve lift point, often called "central angle $\phi$", given by the variable phase control mechanism of FIG. 6.

Referring now to FIG. 6, there is shown one example of variable phase control mechanism 40. As appreciated from the cross section of FIG. 6, the helical spline type variable valve timing control mechanism is used to variably continuously change a phase of central angle $\phi$ of the working angle of intake valve 1, with respect to crankshaft 8. As best seen in FIG. 6, an intake-valve cam pulley 43 is coaxially installed on the outer periphery of intake-valve drive shaft 23. Although it is not clearly shown in FIGS. 2 and 3, an exhaust-valve cam pulley, having almost the same outside diameter as the intake-valve cam pulley 43, is coaxially installed on the outer periphery of exhaust-valve drive shaft 14 arranged parallel to intake-valve drive shaft 23. For power transmission from crankshaft 8 to both of intake-valve drive shaft 23 and exhaust-valve drive shaft 14, a timing belt is wrapped around the intake-valve cam pulley, the exhaust-valve cam pulley, and a crank pulley (now shown) fixedly connected to one end of crankshaft 8. The belt drive permits intake-valve drive shaft 23 and exhaust-valve drive shaft 14 to rotate in synchronism with rotation of the crankshaft. Generally, in synchronism with rotation of crankshaft 8, each of intake-valve drive shaft 23 and exhaust-valve drive shaft 14 rotates about its axis at one-half the rotational speed of crankshaft 8. Intake-valve and exhaust-valve cam sprockets, a crank sprocket and a timing chain may be used for power transmission, instead of using the intake-valve and exhaust-valve cam pulleys, crank pulley and timing belt. As shown in FIG. 6, the variable valve timing control mechanism (serving as variable phase control mechanism 40) is comprised of a drive gear portion 44, a driven gear portion 45, a cylindrical plunger (a helical ring gear) 46, and a hydraulic chamber 41. Drive gear portion 44 is integrally formed with or integrally connected to the inner periphery of intake-valve cam pulley 43, so as to rotate together with the intake-valve cam pulley. Driven gear portion 45 is integrally formed with or integrally connected to the outer periphery of intake-valve drive shaft 23 so as to rotate together with the intake-valve drive shaft. Cylindrical plunger (helical ring gear) 46 has inner and outer helical toothed portions, respectively in meshed-engagement with an outer helical toothed portion of driven gear portion 45 and an inner helical toothed portion of drive gear portion 44. Hydraulic chamber 41 faces the leftmost end (viewing FIG. 6) of plunger 46 so that the plunger is forced axially rightwards against the spring bias of a return spring 48 by changing the hydraulic pressure in hydraulic chamber 41 via second hydraulic control module 42. The hydraulic pressure applied to hydraulic chamber 41 is regulated or modulated by way of second hydraulic control module 42 (a phase control hydraulic modulator), which is responsive to a control signal from ECU 11. The axial movement of plunger 46 changes a phase of intake-valve cam pulley 43 relative to intake-valve drive shaft 23. The relative rotation of drive shaft 23 to cam pulley 43 in one rotational direction results in a phase advance at the maximum intake-valve lift point (at the central angle $\phi$). The relative rotation of drive shaft 23 to cam pulley 43 in the opposite rotational direction results in a phase retard at the maximum intake-valve lift point. As appreciated from the phase-change characteristic curves shown in FIG. 7, only the phase of working angle (i.e., the angular phase at central angle $\phi$) is advanced (see the characteristic curve of a central angle $\phi_1$ of FIG. 7) or retarded (see the characteristic curve of a central angle $\phi_2$ of FIG. 7), with no valve-lift change and no working-angle change. The relative angular position of drive shaft 23 to cam pulley 43 can be continuously varied within predetermined limits by means of second hydraulic control module 42, and thus the angular phase at central angle $\phi$ also varies continuously. In the shown embodiments, each of the lift and working-angle control actuator and the phase control actuator are constructed as a hydraulic actuator. Instead of using the hydraulic actuator, the lift and working-angle control actuator and the phase control actuator may be constructed as electromagnetically-controlled actuators. For variable lift and working-angle control and variable phase control, a first sensor that detects a valve lift and working angle and a second sensor that detects an angular phase at central angle $\phi$ may be added, and variable lift and working-angle control mechanism 20 and variable phase control mechanism 40 may be feedback-controlled respectively based on signals from the first and second sensors at a "closed-loop" mode. In lieu thereof, variable lift and working-angle control mechanism 20 and variable phase control mechanism 40 may be merely feedforward-controlled depending on engine/vehicle operating conditions at an "open-loop" mode.

As discussed above, in the shown embodiment, variable lift and working-angle control mechanism 20 is used in combination with variable phase control mechanism 40, and therefore it is possible to continuously vary all of the valve lift, the working angle, and the phase of central angle $\phi$ of the working angle of intake valve 1. Additionally, it is possible to adjust the intake-valve open timing IVO and the intake-valve closure timing IVC independently of each other, thus ensuring a high-precision intake valve lift characteristic control, in other words, enabling a high-precision intake-air quantity control at the intake valve side. In contrast, the exhaust valve side uses the conventional direct-driven valve operating mechanism that exhaust-valve lifter 2*c* is driven directly by means of fixed cam 15 formed as an integral section of exhaust-valve drive shaft 14. In comparison with the intake valve operating mechanism having a somewhat complicated construction, the exhaust valve operating mechanism is simple.

Returning to FIG. 2, detailed construction of variable piston stroke characteristic mechanism 60 is described hereunder. In the shown embodiment, variable piston stroke characteristic mechanism 60 is constructed by a multiple-link type piston crank mechanism or a multiple-link type variable compression ratio mechanism. A linkage of variable piston stroke characteristic mechanism 60 is composed of three links, namely an upper link 62, a lower link 63 and a control link 71. One end of upper link 62 is connected via a piston pin 6*a* to reciprocating piston 6. Lower link 63 is oscillatingly connected or linked to the other end of the upper link via a first link pin 64. Lower link 63 is also linked to or rotatably fitted on a crankpin 8*a* of engine crankshaft 8. As can be seen in FIG. 2, from the viewpoint of time saved in installation, lower link 63 has a half-split structure. A piston-stroke-characteristic control shaft (simply, a piston control shaft) 65 is also provided in a manner so as to extend substantially parallel to crankshaft 8 in the cylinder-row direction. Piston control shaft 65 is rotatably supported or mounted on cylinder block 4 by way of a main bearing cap 9 and a sub-bearing cap 67. Control link 71 is oscillatingly connected at one end to piston control shaft 65. Control link 71 is oscillatingly connected at the other end to lower link 63 via a second link pin 72, so as to restrict the degree of freedom of the lower link. Piston control shaft 65 is formed with a plurality of pin journals or eccentric journal portions each of which is formed for every engine cylinder and rotatably supported by a bearing (not shown) provided at the lower end of control link 71. A rotation center P1 of each pin journal is eccentric to a rotation center P2 of piston control shaft 65 by a predetermined eccentricity. The rotation center P1 of pin journals serves as a center of oscillating motion of control link 71 that oscillates about the rotation center P2 of piston control shaft 65. As can be appreciated from FIG. 2, the center P1 of oscillating motion of control link 71 varies due to rotary motion of piston control shaft 65. As a result, at least one of the top dead center (TDC) position and the bottom dead center (BDC) position can be varied and thus the piston stroke characteristic can be varied. That is, it is possible to increase or decrease the geometrical compression ratio $\epsilon$, defined as a ratio $(V_1+V_2)/V_1$ of the full volume $(V_1+V_2)$ existing within the engine cylinder and combustion chamber with the piston at BDC to the clearance-space volume $(V_1)$ with the piston at TDC, by varying the center P1 of oscillating motion of control link 71. In other words, changing or shifting the center of oscillating motion of control link 71, causes the attitude of lower link 63 to change, thereby varying at least one of the TDC position and BDC position of reciprocating piston 6 and consequently varying geometrical compression ratio $\epsilon$ of the engine. The previously-noted piston control shaft 65 is driven by means of an electronically controlled piston-stroke characteristic control actuator 61 such as an electric motor. As seen in FIG. 2, a worm gear 68 is attached to the output shaft of actuator 61, while a worm wheel 69 is fixedly connected to piston control shaft 65 so that the worm wheel is coaxially arranged with respect to the axis of piston control shaft 65. Actuator 61 is controlled in response to a control signal from ECU 11 depending on engine operating conditions, and thus the center of oscillating motion of control link 71 can be varied. For variable piston stroke characteristic control, a piston-stroke sensor that detects a piston stroke of reciprocating piston 6 may be added, and variable piston stroke characteristic mechanism 60 may be feedback-controlled based on a signal from the piston-stroke sensor at a "closed-loop" mode. Alternatively, variable piston stroke characteristic mechanism 60 may be merely feedforward-controlled depending on engine/vehicle operating conditions at an "open-loop" mode. Variable piston stroke characteristic control mechanism 60 can continuously vary the compression ratio and optimize the piston stroke characteristic itself. Additionally, instead of linking control link 71 to upper link 62, control link 71 is actually linked to lower link 63. Therefore, piston control shaft 65 that is connected to control link 71 can be laid out within the lower right-hand corner (a comparatively wide space) of the crankcase, in other words, in the internal space of oil pan 10. This is advantageous with respect to ease of assembly. This also prevents the cylinder block from being undesirably large-sized due to addition of variable piston stroke characteristic mechanism 60.

Figure 8:
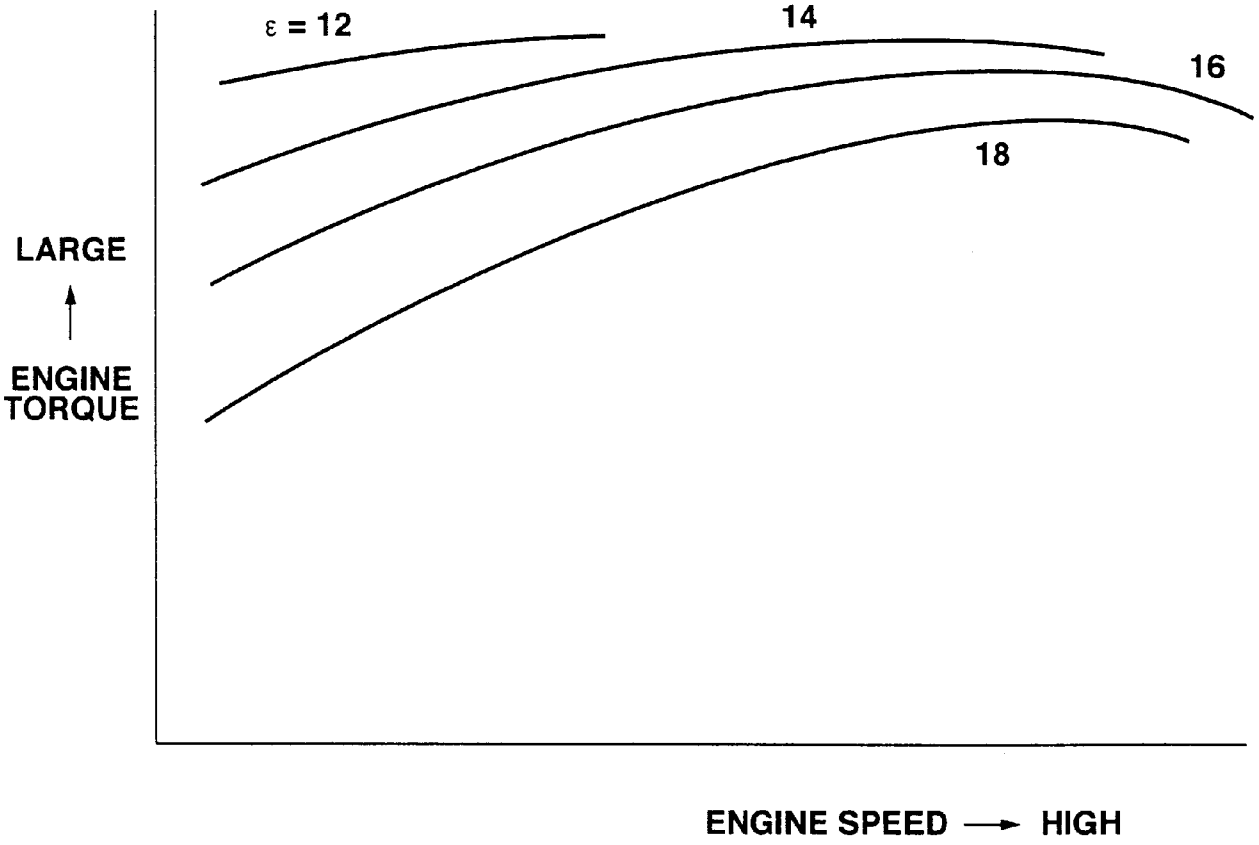
FIG. 8 shows characteristic curves for compression ratio $\epsilon$ variably controlled by the variable piston stroke characteristic mechanism depending on engine operating conditions.

Referring now to FIG. 8, there is shown the predetermined or preprogrammed characteristic curves for compression ratio $\epsilon$ variably controlled by means of variable piston stroke characteristic mechanism 60 depending on engine operating conditions (such as engine load and engine speed)

of the spark-ignition reciprocating internal combustion engine employing variable lift and working-angle control mechanism 20, variable phase control mechanism 40, and variable piston stroke characteristic mechanism 60 combined with each other. As can be seen from the preprogrammed characteristic curves of FIG. 8, the control characteristic of compression ratio $\epsilon$ can be determined by only a change in the full volume ($V_1+V_2$) existing within the engine cylinder and combustion chamber with the piston at BDC, whose volume change occurs due to a change in piston stroke characteristic controlled or determined by variable piston stroke characteristic mechanism 60. On the other hand an effective compression ratio $\epsilon'$ that is correlated to the geometrical compression ratio $\epsilon$ and defined as a ratio of the effective cylinder volume corresponding to the maximum working medium volume to the effective clearance volume corresponding to the minimum working medium volume, is determined depending on the intake valve open timing (IVO) and the intake valve closure timing (IVC) which is dependent on the engine operating conditions, that is, at idle, at part load whose condition is often abbreviated to "R/L (Road/load)" substantially corresponding to a ¼ throttle opening, during acceleration, at full throttle and low speed, and at full throttle and high speed (see FIG. 9).

Figure 9:
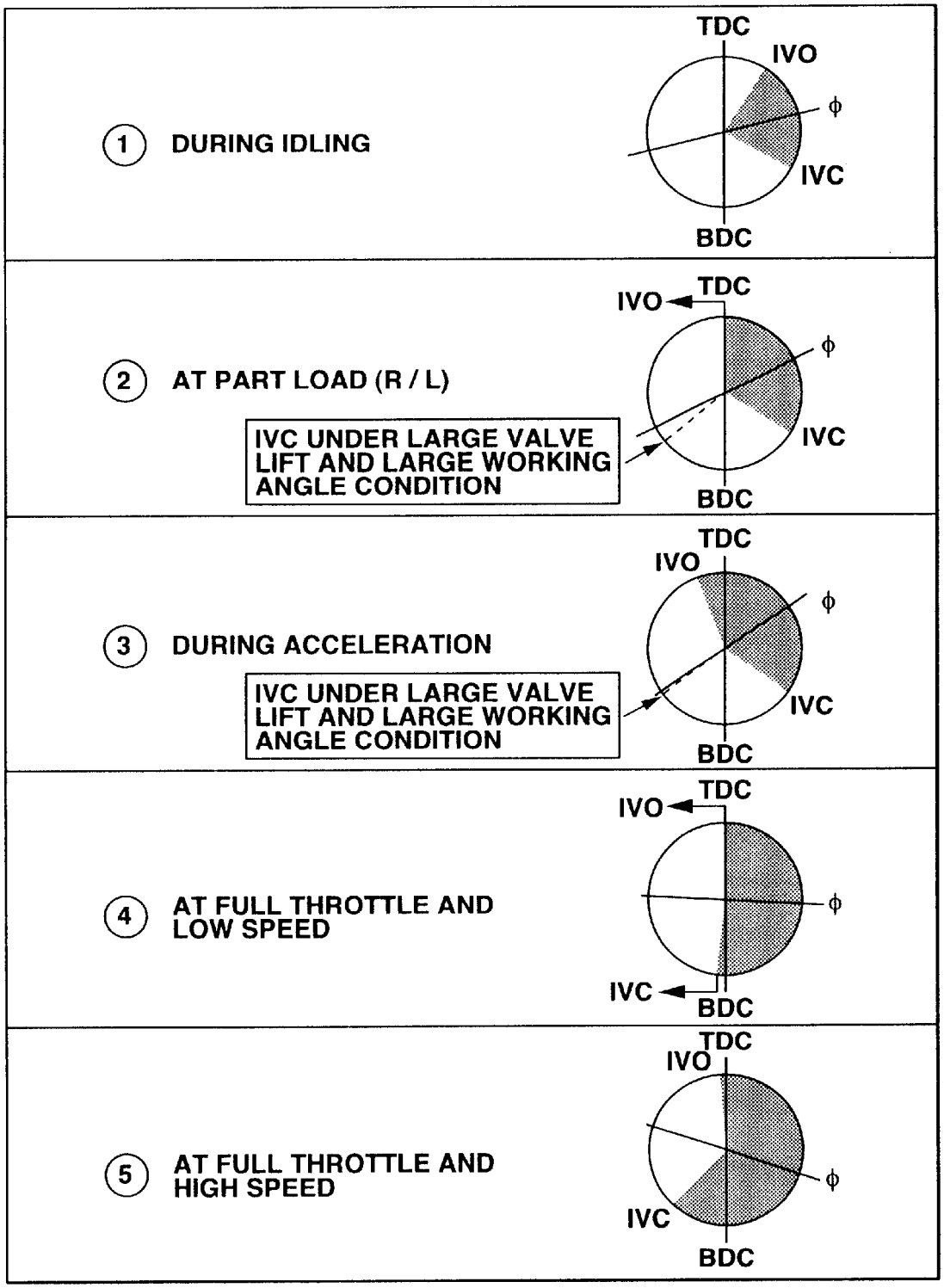
FIG. 9 is an explanatory view showing the operation of the intake valve, in other words, an intake valve open timing (IVO) and an intake valve closure timing (IVC), under various engine/vehicle operating conditions, that is, during idling, at part load, during acceleration, at full throttle and low speed, and at full throttle and high speed.

As shown in FIG. 9, at the idling condition ① and at the part load condition ②, each of the valve lift and working angle of the intake valve is controlled to a comparatively small value. On the other hand, the intake valve closure timing (IVC) is phase-advanced to a considerably earlier point before bottom dead center (BBDC). Due to the IVC considerably advanced, it is possible to greatly reduce the pumping loss. At this time, assuming that compression ratio $\epsilon$ is kept fixed, the effective compression ratio $\epsilon'$ tends to reduce. The reduced effective compression ratio deteriorates the quality of combustion of the air-fuel mixture in the engine cylinder. Therefore, in such a low engine-load range (in a small engine torque range) such as under the idling condition ① and under the part load condition ②, as can be appreciated from the engine operating conditions (engine speed and load) versus compression ratio characteristic curves of FIG. 8, compression ratio $\epsilon$ is set or adjusted to a higher compression ratio.

Under the acceleration condition ③, in order to enhance the charging efficiency of intake air, the valve lift of intake valve 1 is controlled to a comparatively large value, and the valve overlap period is also increased. As compared to the idling condition ① and part load condition ②, the IVC at acceleration condition ③ is closer to BDC, but somewhat phase-advanced to an earlier point before BDC. Under the acceleration condition ③, as a matter of course the throttle opening is increased in comparison with the two engine operating conditions ① and ②. On the other hand, compression ratio $\epsilon$ is set or adjusted to a lower compression ratio than the light load condition ②. The decreasingly-compensated compression ratio is necessary to prevent combustion knock from occurring in the engine.

Under the full throttle and low speed condition ④ or under the full throttle and high speed condition ⑤, in order to produce the maximum intake-air quantity, effective compression ratio $\epsilon'$ is controlled to a higher effective compression ratio than the above three engine operating conditions ①, ② and ③. Therefore, under the full throttle and low speed condition, compression ratio $\epsilon$ determined by the controlled piston stroke characteristic is set to a low compression ratio substantially identical to that of a conventional fixed compression-ratio internal combustion engine. In contrast to the above, under the full throttle and high speed condition, combustion is completed before a chemical reaction for peroxide (one of factors affecting combustion knock) develops, and thus compression ratio $\epsilon$ determined by the controlled piston stroke characteristic is set to a higher compression ratio than that under the full throttle low speed condition. Due to setting to a higher compression ratio, an expansion ratio becomes high and thus the exhaust temperature also becomes lowered suitably, thereby preventing catalysts used in a catalytic converter from being degraded undesirably. Actually; to optimize the above-mentioned parameters, namely the intake-valve lift, intake-valve working angle, intake-valve central angle $\phi$ and compression ratio $\epsilon$ determined by the controlled piston stroke characteristic, at various engine/vehicle operating conditions such as engine speed and engine load, these parameters (the lift, working angle, $\phi$, $\epsilon$) are determined depending on predetermined or preprogrammed characteristic maps. On the other hand, the ignition timing is controlled by means of electronic ignition-timing control system 13 that uses a signal from the throttle-opening sensor or the accelerator-opening sensor to optimize the ignition timing for engine operating conditions. In particular, when a knocking condition is detected, the ignition timing is retarded by means of ignition-timing control system 13.

Returning to FIGS. 1 (single-link type) and 2 (multi-link type), the essential linkage and valve operating mechanism layout of the embodiment is hereinafter described in detail.

Figure 1:
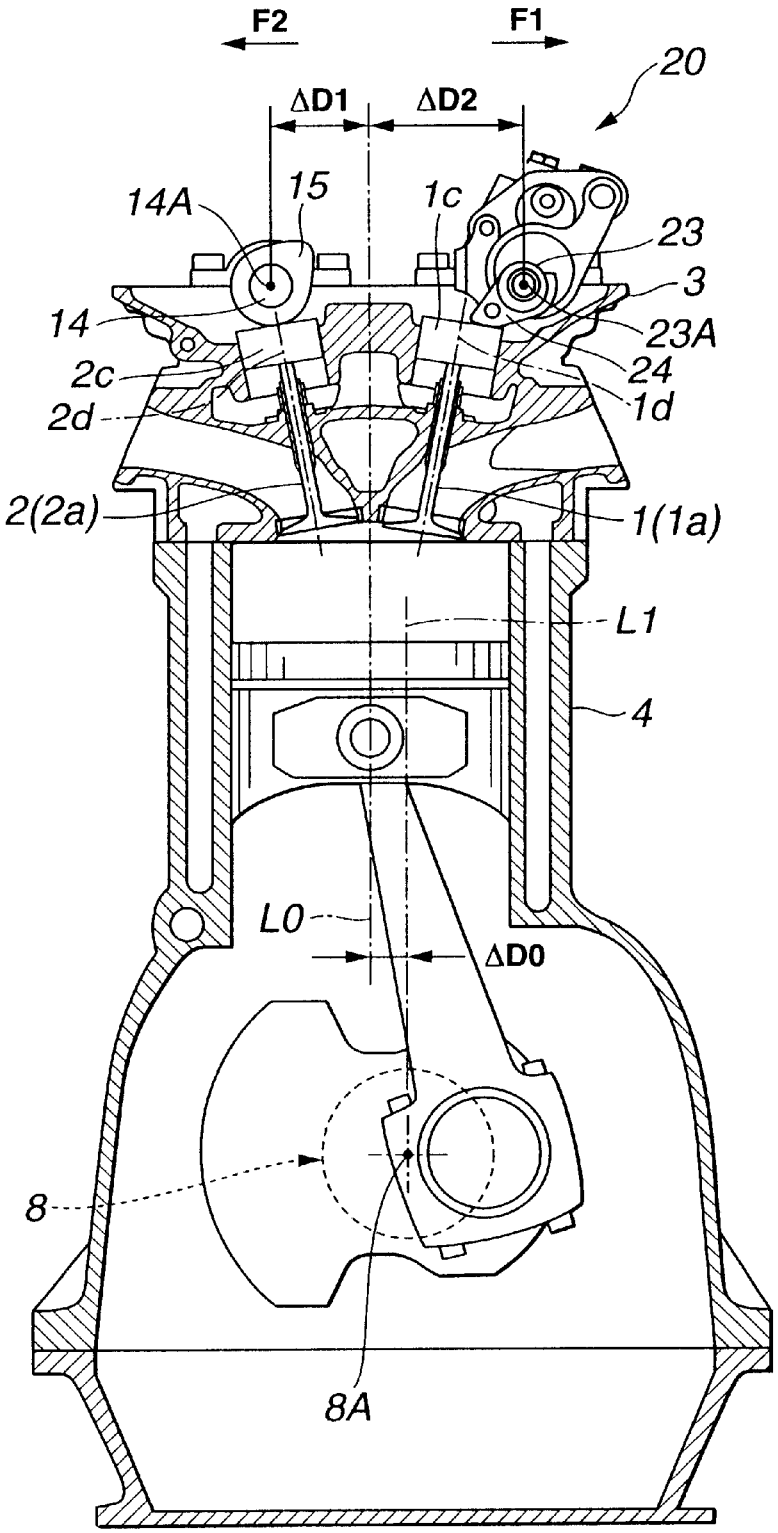
FIG. 1 is a cross-sectional view illustrating the essential linkage and valve operating mechanism layout of the embodiment, which is applied to a single-link type reciprocating engine, as viewed from the axial direction of the crankshaft.

As best seen in FIG. 1, in the reciprocating engine of the embodiment, crankshaft axis 8A is offset from cylinder centerline L0 by a predetermined crankshaft offset ΔD0 in a first direction (hereinafter is referred to as "intake-valve direction F1") that is normal to both the cylinder centerline L0 and the crankshaft axis 8A. An axis 23A (corresponding to the center of oscillating motion of rockable cam 24) of intake-valve drive shaft 23 is offset from a centerline 1*d* of intake-valve stem 1*a* toward the intake valve side (in intake-valve direction F1) by a predetermined rockable-cam offset ΔD5 (see FIG. 11). In contrast, on the exhaust valve side, an axis 14A (corresponding to the rotation center of fixed cam 15) of the exhaust-valve camshaft (exhaust-valve drive shaft 14) lies on the prolongation of a centerline 2*d* of exhaust-valve stem 2*a*. As a consequence, an offset ΔD2 of axis 23A of intake-valve drive shaft 23 from cylinder centerline L0 is dimensioned to be greater than an offset ΔD1 of axis 14A of exhaust-valve drive shaft 14 from cylinder centerline L0, that is, ΔD2>ΔD1. Additionally, in the shown embodiment, in order to realize or attain a predetermined layout (that is, a substantially symmetric layout) between intake-valve drive shaft axis 23A and exhaust-valve drive shaft axis 14A with respect to a crank reference line L1 parallel to cylinder centerline L0 and passing through crankshaft axis 8A, the previously-noted predetermined rockable-cam offset ΔD5 (see FIG. 11) is dimensioned to be substantially two times greater than the previously-noted predetermined crankshaft offset ΔD0, that is, ΔD5≈ΔD0. Therefore, although only the intake-valve drive shaft axis 23A of the intake valve side is offset from the intake-valve stem centerline 1*d*, intake-valve drive shaft axis 23A and exhaust-valve drive shaft axis 14A can be laid out in a predetermined position relationship therebetween (for example, these drive shaft axes 23A and 14A are substantially symmetrical with respect to crank reference line L1), in a similar manner as the conventional direct-driven valve operating mechanism that a valve lifter is driven directly by means of a fixed cam formed as an integral section of a camshaft. For the reasons set forth above, the rockable cam equipped reciprocating engine arrangement of the embodiment can be easily applied to the conventional reciprocating engine equipped with a direct-driven valve operating mechanism that a valve lifter is driven directly by means of a fixed cam formed as an integral section of a camshaft, without largely changing the power transmission system layout of the engine front end on which a cam pulley, a cam sprocket or the like is installed, and the geometry and dimensions between the engine-valve drive shaft and the crankshaft. In other words, the rockable cam equipped reciprocating engine arrangement of the embodiment can be easily applied to the conventional reciprocating engine equipped with a direct-driven valve operating mechanism, by way of a comparatively easy change in design for the shape of the interior of each of cylinder head 3 and cylinder block 4. The practicability of the improved layout of the embodiment is high.

In addition to the above, in the shown embodiment, crankshaft axis 8A is offset from cylinder centerline L0 toward the intake valve side by predetermined crankshaft offset ΔD0 in intake-valve direction F1. In other words, cylinder centerline L0 is offset from crankshaft axis 8A by predetermined crankshaft offset ΔD0 in an exhaust-valve direction F2 opposite to intake-valve direction F1. That is, structural members of the engine skeletal structure, such as cylinder head 3 and cylinder block 4, are designed to be offset in exhaust-valve direction F2 with respect to crankshaft 8. Thus, it is possible to widen an engine external space of the intake valve side whose temperature is relatively low and in which an air cleaner and an air compressor made of synthetic resin materials are often installed. This enhances the ease of installation of such component parts on the engine body.

Figure 10B:
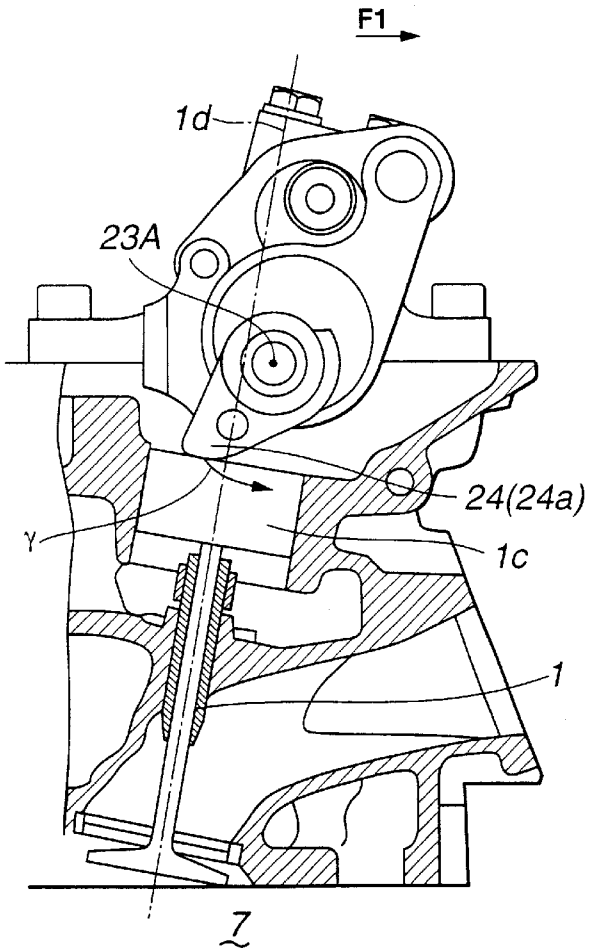
FIGS. 10A and 10B are explanatory views of the sense of offset of the intake-valve drive shaft from the intake-valve stem centerline and the operation and effects, respectively showing the aligned layout of a first comparative example and the offset layout of the embodiment.
Figure 10A:
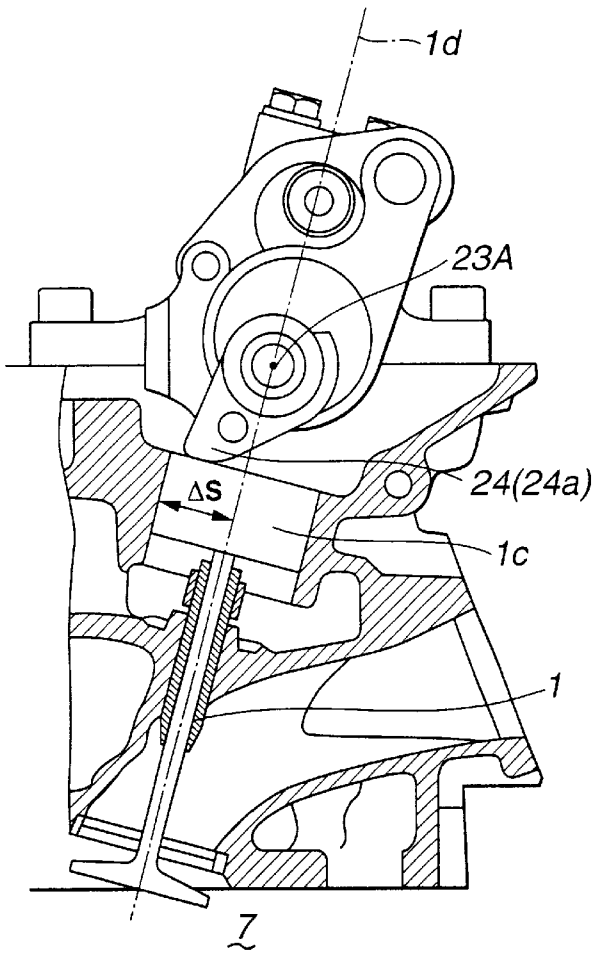

Referring now to FIGS. 10A and 10B, there is shown the partial cross-sectional views showing the sense (or the direction) of offset of the intake-valve drive shaft from the intake-valve stem centerline and the differences of the operation and effects between the aligned layout of the first comparative example and the offset layout of the embodiment. In the aligned layout of the first comparative example shown in FIG. 10A in which intake-valve drive shaft axis 23A is aligned with and lies on the prolongation of centerline 1*d* of intake-valve stem 1*a* as viewed from the axial direction of the crankshaft, the actual contact area between rockable cam 24 and intake-valve lifter 1*c* tends to be remarkably offset from the intake-valve stem centerline 1*d* and limited to a substantially left-hand half contact area ΔS (viewing FIG. 10A). As discussed above, in case of the eccentric contact that the actual contact area is limited to a very limited contact zone less than or equal to the aforementioned contact area ΔS, the variable width (or variable band) of the valve lift and working-angle characteristic tends to be contracted or reduced. Additionally, the eccentric contact causes the side thrust acting on the intake-valve lifter to increase. In contrast to the above, in case of the offset layout of the embodiment shown in FIG. 10B in which intake-valve drive shaft axis 23A is offset from the intake-valve stem centerline 1*d* toward the intake valve side by predetermined rockable-cam offset ΔD5 (see FIG. 11) as viewed from the axial direction of the crankshaft, during a lifting-up period that the rockable cam rotates toward the maximum valve lift point and thus the opening of intake valve 1 is increasing, rockable cam 24 is arranged and geometrically dimensioned so that cam nose portion 24*a* of rockable cam 24 rotates in intake-valve direction F1 corresponding to an offset direction of intake-valve drive shaft axis 23A. That is, during the lifting-up period, a rotational direction γ of cam nose portion 24*a* is designed to be identical to intake-valve direction F1. By way of such an optimal offset setting of intake-valve drive shaft axis 23A (corresponding to the center of oscillating motion of rockable cam 24), it is possible to realize cam-contact between rockable cam 24 and intake-valve lifter 1*c* within a wide range of contact area, ranging from the left-hand side contact area via the intake-valve stem centerline to the right-hand side contact area. Owing to the wide range of contact area the offset layout of the embodiment of FIG. 10B ensures a greater variable width of the valve lift and working-angle characteristic than the aligned layout of the first comparative example of FIG. 10A. The left-hand side contact area and the right-hand side contact area are essentially symmetrically and evenly arranged with respect to intake-valve stem centerline 1*d*. This reduces side thrust acting on the intake-valve lifter. From the viewpoint of reduced side thrust and the wider variable width of the valve lift and working-angle characteristic, in the rockable cam equipped reciprocating engine, it is desirable that intake-valve drive shaft axis 23A (corresponding to the center of oscillating motion of rockable cam 24) is offset from intake-valve stem centerline 1*d* by predetermined rockable-cam offset ΔD5.

Figure 11:
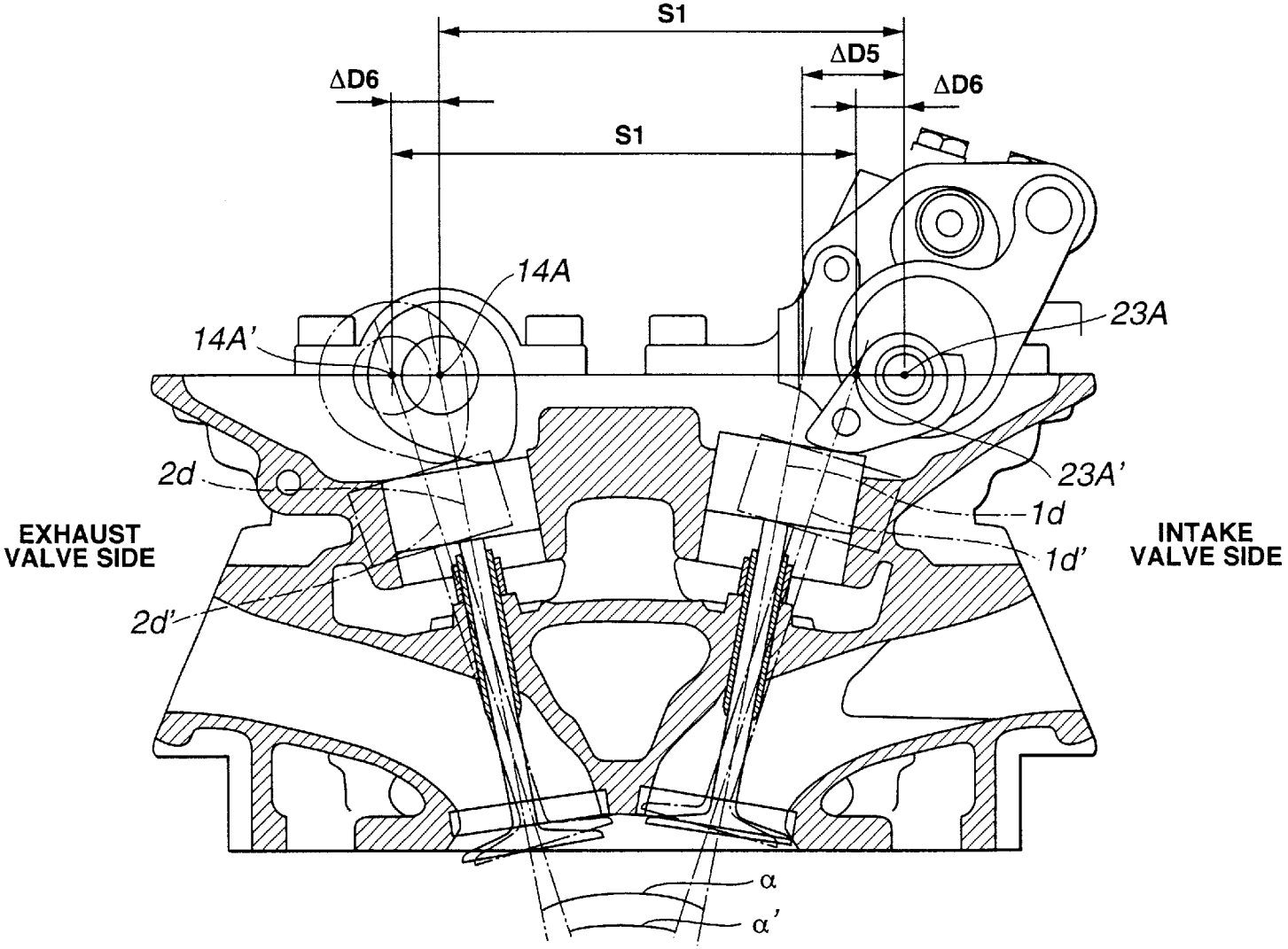
FIG. 11 is a partial cross-sectional view showing the difference between the engine valve operating mechanism layout of the embodiment and the engine valve operating mechanism layout of a second comparative example.

As seen in FIG. 11, the center distance between intake-valve drive shaft 23 and exhaust-valve drive shaft 14 is restricted or limited by the size or dimensions (containing the outside diameter) of intake-valve cam pulley 43 (or the intake-valve cam sprocket) and the size or dimensions (containing the outside diameter) of the exhaust-valve cam pulley (or the exhaust-valve cam sprocket). For instance, the center distance between intake-valve drive shaft 23 and exhaust-valve drive shaft 14 is restricted to a value greater than a predetermined minimum center distance S1. In other words, in case of the center distance has to be designed or set to a value less than predetermined minimum center distance S1, usually the power transmission system of the engine front end mounting thereon a cam pulley, a cam sprocket or the like and designed to transmit the driving power from the crankshaft to each of intake- and exhaust-valve drive shafts 23 and 14, has to be wholly changed. In case of the second comparative example (indicated by the phantom line in FIG. 11) in which a direct-driven valve operating mechanism that a valve lifter is driven directly by means of a fixed cam formed as an integral section of a camshaft is applied to each of the intake and exhaust valve sides, an intake-valve drive shaft axis 23A' lies on the prolongation of an intake-valve stem centerline 1*d*', while an exhaust-valve drive shaft axis 14A' lies on the prolongation of an exhaust-valve stem centerline 2*d*'. In contrast, in case of the embodiment (indicated by the solid line in FIG. 11) in which a direct-driven valve operating mechanism that a valve lifter is driven directly by means of a fixed cam formed as an integral section of a camshaft is applied to the exhaust valve side and a rockable-cam equipped valve operating mechanism is applied to the intake valve side, intake-valve drive shaft axis 23A is offset from intake-valve stem centerline 1*d* toward the intake valve side (in intake-valve direction F1) by predetermined rockable-cam offset ΔD5, while exhaust-valve drive shaft axis 14A lies on the prolongation of exhaust-valve stem centerline 2*d*. Therefore, the angle α between intake-valve stem centerline 1*d* and exhaust-valve stem centerline 2*d* in the rockable-cam equipped reciprocating engine of the embodiment (indicated by the solid line in FIG. 11) can be dimensioned to be smaller than the angle α' between intake-valve stem centerline 1*d*' and exhaust-valve stem centerline 2*d*' in the non-rockable-cam equipped reciprocating engine of the second comparative example (indicated by the phantom line in FIG. 11), while ensuring the same center distance S1. That is, according to the rockable-cam equipped reciprocating engine design of the embodiment, it is possible to effectively reduce the angle between the intake-valve stem centerline and the exhaust-valve stem centerline without shortening the center distance. Assuming that the layout of the second comparative example is modified such that only the intake-valve drive shaft 23 is simply offset from intake-valve stem centerline 1*d* toward the intake valve side, only the inclination of intake-valve stem centerline 1*d* with respect to cylinder centerline L0 tends to undesirably increase. For the reasons set forth above, when the layout of the second comparative example is modified such that a rockable cam is equipped in the intake valve side and the intake-valve drive shaft is offset from intake-valve stem centerline 1*d* toward the intake valve side, according to the improved layout of the rockable-cam equipped reciprocating engine of the embodiment, in order for the modified inclination of intake-valve stem centerline 1*d* with respect to cylinder centerline L0 to be identical to the modified inclination of exhaust-valve stem centerline 2*d* with respect to cylinder centerline L0, the layout of the second comparative example is modified so that intake-valve drive shaft axis 23A and exhaust-valve drive shaft axis 14A are offset from the respective original positions (corresponding to intake-valve drive shaft axis 23A' and exhaust-valve drive shaft axis 14A' of the second comparative example) in the same direction or in the rightward direction (viewing FIG. 11) by the same offset ΔD6.

Figure 12:
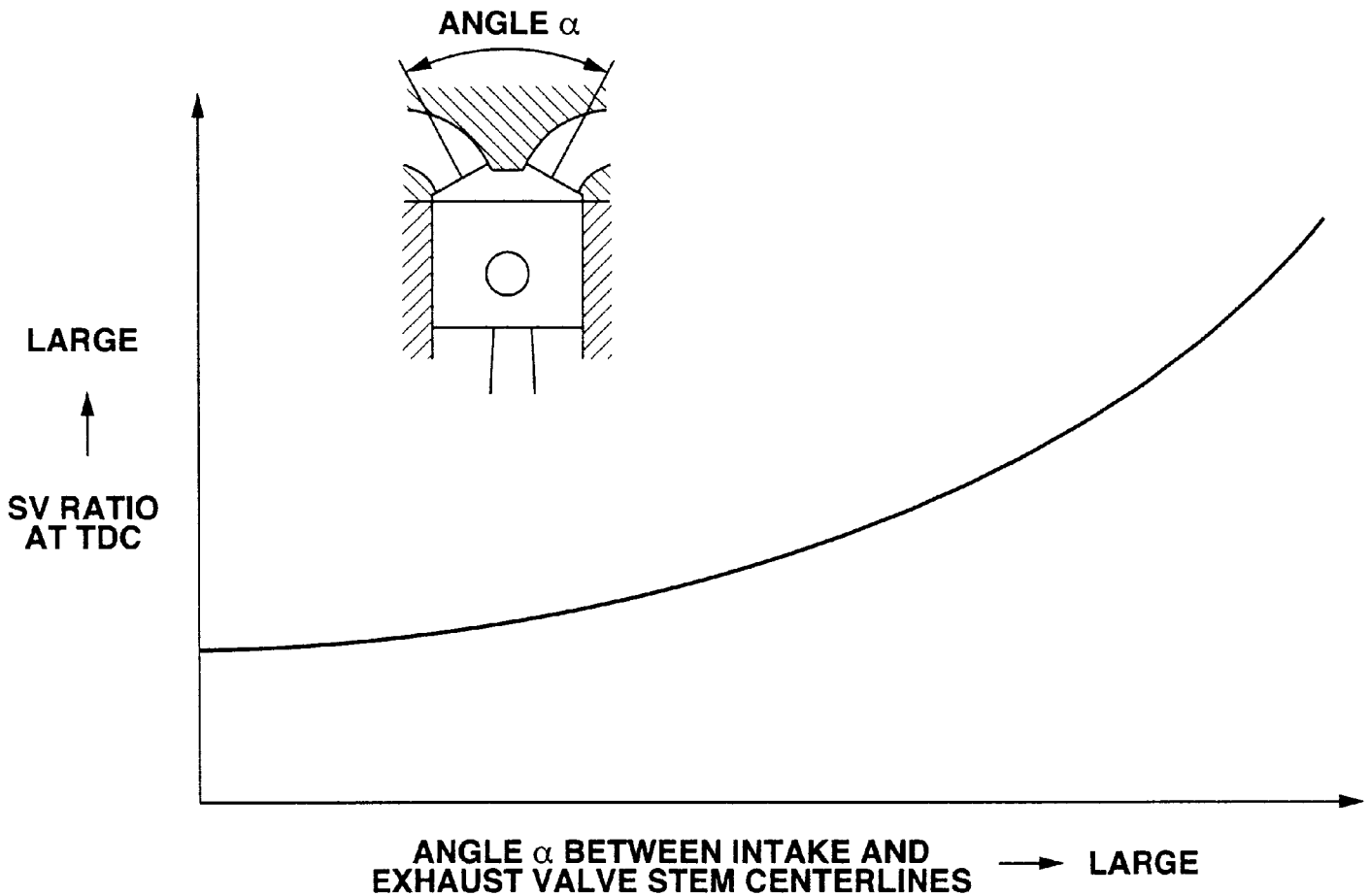
FIG. 12 is a characteristic diagram showing the relationship between an S/V ratio of the combustion chamber and an angle between the intake-valve stem centerline and the exhaust-valve stem centerline.

The effect of the narrowed angle α between intake-valve stem centerline 1*d* and exhaust-valve stem centerline 2*d* in the rockable-cam equipped reciprocating engine of the embodiment is hereinbelow described in detail by reference to the angle versus S/V ratio characteristic diagram shown in FIG. 12. Owing to the narrowed angle α between intake-valve stem centerline 1*d* and exhaust-valve stem centerline 2*d*, a so-called S/V ratio of the surface area existing within the combustion chamber to the volume existing within the combustion chamber tends to reduce. Generally, the reduced S/V ratio is correlated to the improved shape of the combustion chamber. That is, due to the reduced S/V ratio, it is possible to enhance the engine combustion performance (e.g., knocking avoidance or enhanced combustion stability) at a high compression ratio, and to down-size intake and exhaust valves. On the one hand, the reduced valve diameter is advantageous with respect to light weight. On the other hand, the reduced valve diameter leads to the problem of inadequate intake air quantity. In the rockable-cam equipped reciprocating engine of the embodiment, the lift and working angle characteristic of the intake valve side can be variably adjusted depending on engine/vehicle operating conditions by means of variable lift and working-angle control mechanism 20. Thus, it is possible to provide adequate intake air quantity if necessary.

Figure 13:
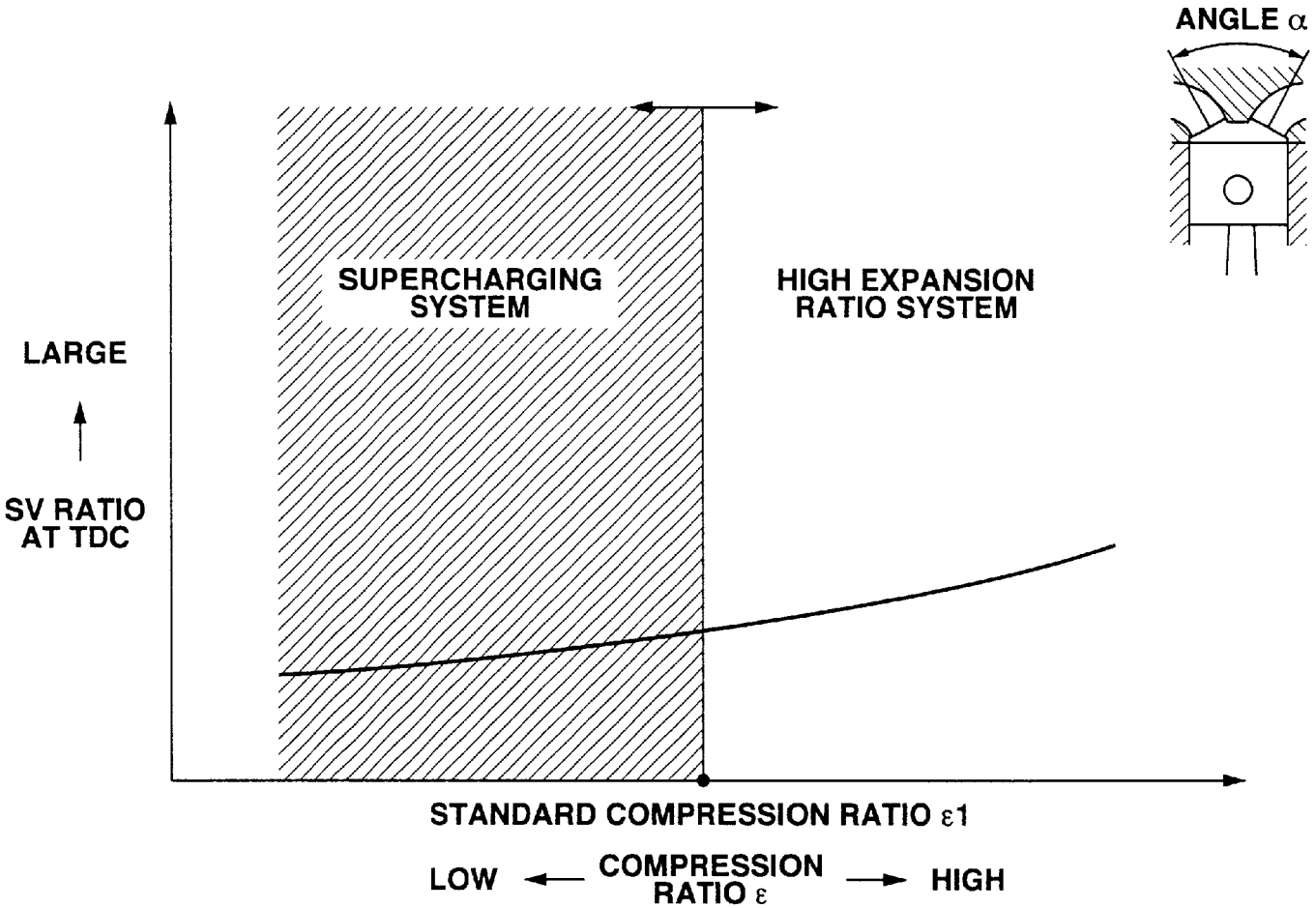
FIG. 13 is a characteristic diagram showing the relationship between the S/V ratio and a compression ratio $\epsilon$.

As discussed above, the rockable-cam equipped reciprocating engine of the embodiment has variable piston stroke characteristic mechanism 60 (in other words, a high expansion ratio system) capable of continuously change the piston stroke characteristic, that is, the compression ratio. By virtue of variable piston stroke characteristic mechanism 60, it is possible to use higher compression ratios as compared to a conventional fixed compression-ratio internal combustion engine whose compression ratio is fixed to a standard compression ratio ε1 (see the right-hand half of FIG. 13). If variable piston stroke characteristic mechanism 60 is combined with a supercharging system (or a turbocharger), in order to enhance a specific power, it is preferable to set or adjust the compression ratio ε to a value lower than standard compression ratio ε1 (see the left-hand half of FIG. 13). In contrast to the above, assuming that the compression ratio is adjusted to a comparatively high value in case of the non-rockable-cam equipped reciprocating engine of the second comparative example indicated by the phantom line of FIG. 11 and having a comparatively large angle α' between intake-valve stem centerline 1*d*' and exhaust-valve stem centerline 2*d*', there is a tendency for the S/V ratio of the combustion chamber to rapidly increase when the piston passes the TDC position. The rapid increase in the S/V ratio results in an increase in cooling loss and a delay in flame propagation. The effect of improved fuel economy based on adjustment of compression ratio ε is cancelled by the undesired increased cooling loss and delayed flame propagation. In contrast, in case of the rockable-cam equipped reciprocating engine of the embodiment that the angle α between intake-valve stem centerline 1*d* and exhaust-valve stem centerline 2*d* is set at an adequately small value, it is possible to effectively suppress an increase in the S/V ratio, which may occur due to an increase in compression ratio ε (a change in the TDC position to a higher position), by way of the satisfactorily reduced or narrowed angle α between intake-valve stem centerline 1*d* and exhaust-valve stem centerline 2*d*. This enhances the combustion performance (containing combustion stability) and improves fuel economy.

Figure 14:
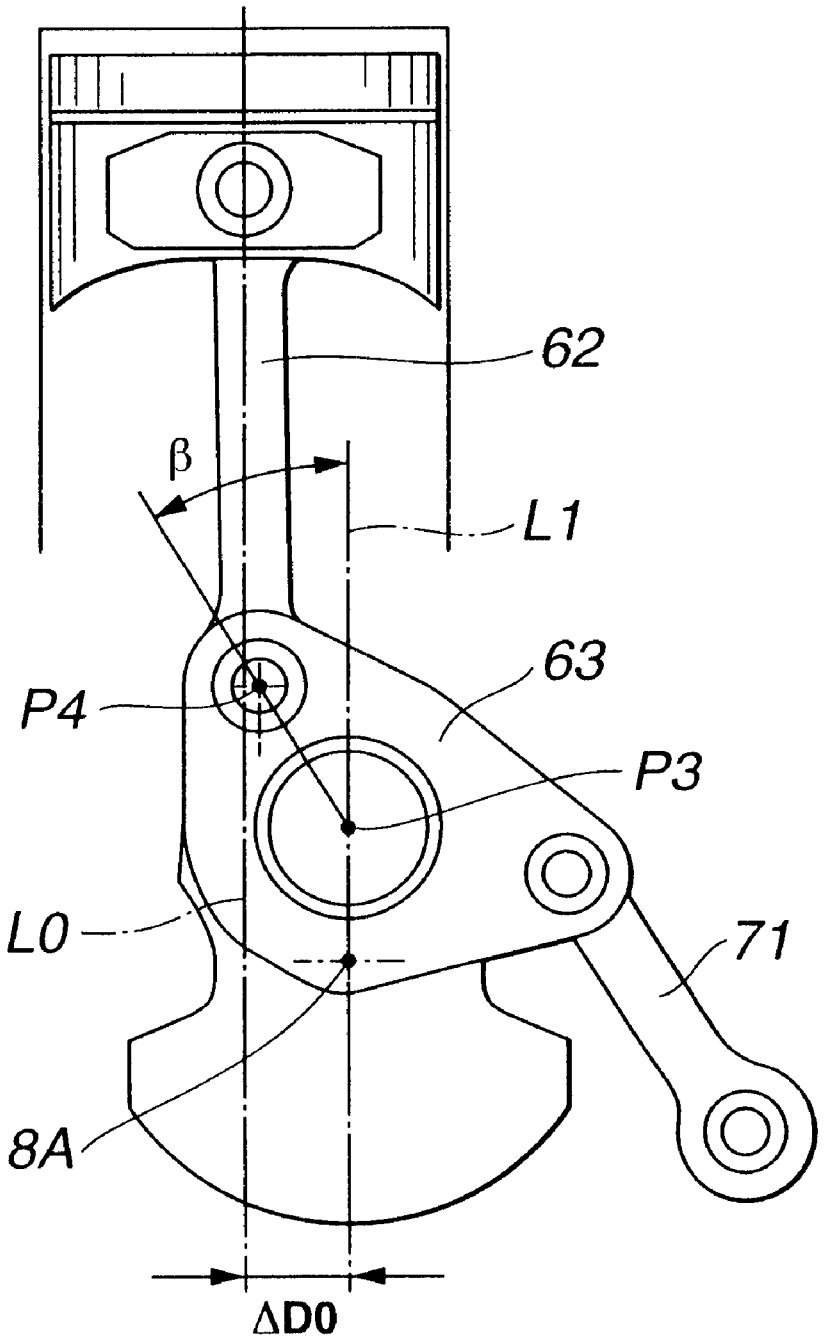
FIG. 14 is a cross-sectional view explaining the operation and effects, occurring owing to the crankshaft offset $\Delta$D0 from the cylinder centerline.
Figure 15:
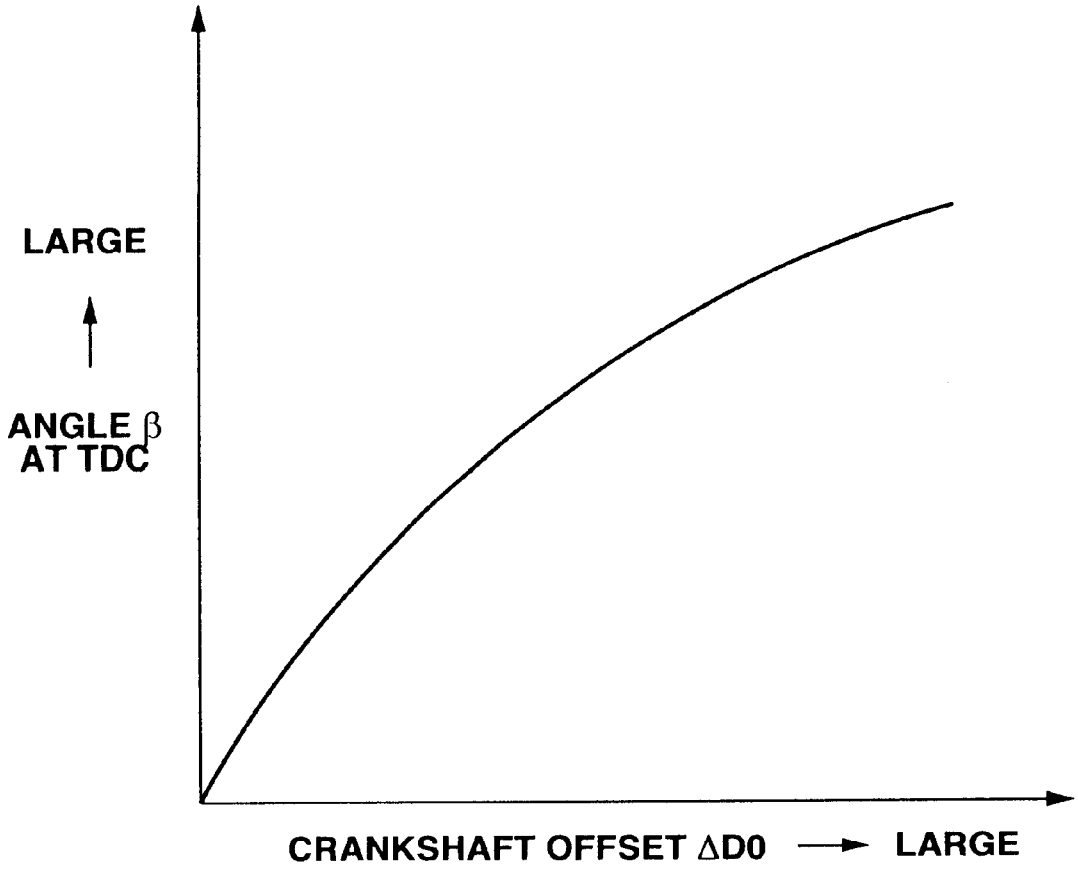
FIG. 15 is a characteristic diagram showing the relationship between the crankshaft offset $\Delta$D0 and an angle $\beta$ between a crank reference line L1 parallel to a cylinder centerline L0 and a line segment P3–P4 between and including both a crankpin center P3 and an upper-link/lower-link connecting-pin center P4.

The operation and effects (reduced variable width or reduced variable band of compression ratio ε varied by variable piston stroke characteristic mechanism 60) obtained in presence of predetermined crankshaft offset ΔD0 of crankshaft axis 8A from cylinder centerline L0 toward the intake valve side (in intake-valve direction F1) are hereunder described in detail by reference to FIGS. 14 and 15. As clearly shown in FIG. 14, an angle denoted by β represents an angle between crank reference line L1 parallel to cylinder centerline L0 and the line segment P3–P4 between and including both the crankpin center P3 and upper-link/lower-link connecting-pin center P4 at the TDC position. As can be seen from the crankshaft offset ΔD0 versus angle β characteristic curve shown in FIG. 15, the angle β tends to increase, as the crankshaft offset ΔD0 increases. Also, the vertical displacement of upper link 62 (in the direction of cylinder centerline L0) relative to the rotational displacement of lower link 63 tends to decrease, as the angle β decreases. In other words, the vertical displacement of upper link 62 relative to the rotational displacement of lower link 63 tends to increase, as the angle β increases. The vertical displacement of upper link 62 is correlated to both a change in the TDC position and a variation in compression ratio ε. Therefore, when the angle β between crank reference line L1 and line segment P3–P4 is increasingly compensated for by increasing crankshaft offset ΔD0 of crankshaft axis 8A from cylinder centerline L0 toward the intake valve side, the variation (the control sensitivity) in compression ratio ε controlled or adjusted by variable piston stroke characteristic mechanism 60 becomes high. In spite of the comparatively compact design, it is possible to provide the adequate variable width of compression ratio ε. It is preferable to set crankshaft offset ΔD0 to a value greater than or equal to 5 mm (that is, ΔD0≧5 mm). It is more preferable to set crankshaft offset ΔD0 to a value ranging from 10 mm to 15 mm (that is, 10 mm≦ΔD0≦15 mm).

In the shown embodiment, variable lift and working-angle control mechanism 20 and variable phase control mechanism 40 are hydraulically operated, while variable piston stroke characteristic mechanism 60 is motor-driven. In lieu thereof, variable lift and working-angle control mechanism

20 and variable phase control mechanism 40 may be electrically operated by means of an electric motor. On the other hand, variable piston stroke characteristic mechanism 60 may be hydraulically operated.

The entire contents of Japanese Patent Application No. P2001-224519 (filed Jul. 25, 2001) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A reciprocating internal combustion engine comprising:

a cylinder block having a cylinder;

a piston movable through a stroke in the cylinder;

an intake valve;

an intake-valve lifter on a stem of the intake valve;

an intake-valve drive shaft that rotates about its axis in synchronism with rotation of a crankshaft;

a rockable cam that is rotatably fitted on an outer periphery of the intake-valve drive shaft, and that oscillates within predetermined limits during rotation of the intake-valve drive shaft so as to directly push the intake-valve lifter; and as viewed from an axial direction of the crankshaft, an axis of the intake-valve drive shaft being offset from a centerline of the intake-valve stem in a first direction that is normal to both a centerline of the cylinder and an axis of the crankshaft and directed from the cylinder centerline to an intake valve side, and the crankshaft axis being offset from the cylinder centerline in the first direction.

2. The reciprocating internal combustion engine as claimed in claim 1, which further comprises:

an exhaust valve;

an exhaust-valve lifter on a stem of the exhaust valve;

an exhaust-valve drive shaft that is arranged parallel to the intake-valve drive shaft and rotates about its axis in synchronism with rotation of the crankshaft; and a fixed cam that is fixed to the exhaust-valve drive shaft so as to directly push the exhaust-valve lifter.

3. The reciprocating internal combustion engine as claimed in claim 1, which further comprises:

a variable lift and working-angle control mechanism that mechanically links the intake-valve drive shaft to the rockable cam to convert rotary motion of the intake-valve drive shaft to oscillating motion of the rockable cam; and the variable lift and working-angle control mechanism continuously varying at least one of a valve lift and a working angle of the intake valve by varying an initial phase of the rockable cam; the working angle being defined as an angle between a crank angle at valve open timing of the intake valve and a crank angle at valve closure timing of the intake valve.

4. The reciprocating internal combustion engine as claimed in claim 3, wherein:

the variable lift and working-angle control mechanism comprises a first eccentric cam which is attached to the intake-valve drive shaft and whose axis is eccentric to the intake-valve drive shaft axis, a control shaft being rotatable about its axis to vary at least one of the valve lift and the working angle of the intake valve is varied, a second eccentric cam which is attached to the control shaft and whose axis is eccentric to an axis of the control shaft, a rocker arm rockably supported on the second eccentric cam, a first link mechanically linking one end of the rocker arm to the first eccentric cam, and a second link mechanically linking the other end of the rocker arm to the rockable cam.

5. The reciprocating internal combustion engine as claimed in claim 1, wherein:

the rockable cam is arranged and geometrically dimensioned so that a cam nose portion of the rockable cam rotates in the first direction during a lifting-up period that the rockable cam rotates toward a maximum valve lift point of the intake valve.

6. The reciprocating internal combustion engine as claimed in claim 1, wherein:

a predetermined offset of the intake-valve drive shaft axis from the intake-valve stem centerline in the first direction is dimensioned to be substantially two times greater than a predetermined offset of the crankshaft axis from the cylinder centerline in the first direction.

7. The reciprocating internal combustion engine as claimed in claim 1, which further comprises:

a variable piston stroke characteristic mechanism that continuously varies a piston stroke characteristic; and the variable piston stroke characteristic mechanism comprising a multi-link type piston crank mechanism having a plurality of links through which a crankpin of the crankshaft is mechanically linked to a piston pin of the piston.

8. The reciprocating internal combustion engine as claimed in claim 7, wherein:

the multi-link type piston crank mechanism comprises a lower link rotatably fitted on an outer periphery of the crankpin, an upper link that links the lower link to the piston pin, a piston-stroke-characteristic control shaft being rotatable about its axis to vary the piston stroke characteristic, an eccentric journal portion which is attached to the piston-stroke-characteristic control shaft and whose axis is eccentric to a rotation center of the piston-stroke-characteristic control shaft, and a control link that links the eccentric journal portion to the lower link.

9. The reciprocating internal combustion engine as claimed in claim 1, which further comprises:

a variable phase control mechanism that continuously varies an angular phase at a central angle corresponding to a maximum valve lift point of the intake valve.

10. The reciprocating internal combustion engine as claimed in claim 2, wherein:

an axis of the exhaust-valve drive shaft lies on a prolongation of a centerline of the exhaust-valve stem; and an offset of the intake-valve drive shaft axis from the cylinder centerline is dimensioned to be greater than an offset of the exhaust-valve drive shaft axis from the cylinder centerline.

* * * * *